US011094517B2

(12) United States Patent
Uematsu et al.

(10) Patent No.: US 11,094,517 B2
(45) Date of Patent: Aug. 17, 2021

(54) METHOD AND DEVICE FOR PREPARING MEASUREMENT SAMPLE FOR MALDI MASS SPECTROMETRY, MEASUREMENT SAMPLE FOR MALDI MASS SPECTROMETRY, MALDI MASS SPECTROMETRY METHOD, AND NON-TRANSITORY RECORDING MEDIUM FOR PREPARING MEASUREMENT SAMPLE FOR MALDI MASS SPECTROMETRY

(71) Applicant: Ricoh Company, Ltd., Tokyo (JP)

(72) Inventors: Katsuyuki Uematsu, Shizuoka (JP); Kazumi Suzuki, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/801,424

(22) Filed: Feb. 26, 2020

(65) Prior Publication Data

US 2020/0303176 A1 Sep. 24, 2020

(30) Foreign Application Priority Data

Mar. 20, 2019 (JP) ..... JP2019-053592
Dec. 24, 2019 (JP) ..... JP2019-232592

(51) Int. Cl.
*H01J 49/04* (2006.01)
*H01J 49/16* (2006.01)
*H01J 49/00* (2006.01)

(52) U.S. Cl.
CPC ..... *H01J 49/0418* (2013.01); *H01J 49/164* (2013.01); *H01J 49/0031* (2013.01)

(58) Field of Classification Search
CPC ... H01J 49/0418; H01J 49/164; H01J 49/0031
See application file for complete search history.

(56) References Cited

U.S. PATENT DOCUMENTS 9,082,600 B1 7/2015 Greving et al.
2005/0019223 A1 1/2005 Platt et al.
(Continued)

FOREIGN PATENT DOCUMENTS

JP 2001-153842 6/2001
JP 2005-510745 4/2005
(Continued)

OTHER PUBLICATIONS

Extended European Search Report dated Jul. 31, 2020 in European Patent Application No. 20160243.0, citing documents AA-AC and AX therein, 14 pages.
(Continued)

*Primary Examiner* — Nicole M Ippolito
*Assistant Examiner* — Hanway Chang
(74) *Attorney, Agent, or Firm* — Xsensus LLP

(57) ABSTRACT

A method for preparing a measurement sample for MALDI mass spectrometry, the method including applying a laser beam to a base containing a matrix disposed on a surface of the base, in a manner that the laser beam is applied to a surface of the base opposite to the surface on which the matrix is disposed, to make the matrix fly from the base to be disposed at a predetermined position of an analyte of MALDI mass spectrometry.

12 Claims, 19 Drawing Sheets

(56) References Cited

U.S. PATENT DOCUMENTS

| | | | | |
|---|---|---|---|---|
| 2012/0085903 | A1* | 4/2012 | Trimpin | H01J 49/044<br>250/282 |
| 2017/0348872 | A1 | 12/2017 | Suzuki et al. | |
| 2018/0201027 | A1 | 7/2018 | Suzuki et al. | |
| 2019/0076361 | A1 | 3/2019 | Onoue et al. | |

FOREIGN PATENT DOCUMENTS

| | | | |
|---|---|---|---|
| JP | 2009-243902 | | 10/2009 |
| JP | 2013-525810 | | 6/2013 |
| JP | 2014-206389 | | 10/2014 |
| WO | WO2003/046945 | A1 | 6/2003 |
| WO | WO2006/025367 | A1 | 3/2006 |
| WO | WO2011/139274 | A1 | 11/2011 |
| WO | WO2016/136722 | A1 | 9/2016 |

OTHER PUBLICATIONS

Kamila Chughtai, et al., "Mass Spectrometric Imaging for Biomedical Tissue Analysis," Chemical Reviews, vol. 110, No. 5, XP002669351, May 12, 2010, pp. 3237-3277.

* cited by examiner

METHOD AND DEVICE FOR PREPARING MEASUREMENT SAMPLE FOR MALDI MASS SPECTROMETRY, MEASUREMENT SAMPLE FOR MALDI MASS SPECTROMETRY, MALDI MASS SPECTROMETRY METHOD, AND NON-TRANSITORY RECORDING MEDIUM FOR PREPARING MEASUREMENT SAMPLE FOR MALDI MASS SPECTROMETRY

CROSS-REFERENCE TO RELATED APPLICATIONS

This patent application is based on and claims priority pursuant to 35 U.S.C. § 119(a) to Japanese Patent Application Nos. 2019-053592 and 2019-232592, filed on Mar. 20, 2019 and Dec. 24, 2019, respectively, in the Japan Patent Office, the entire disclosure of each of which is hereby incorporated by reference herein.

BACKGROUND

Technical Field

The present disclosure relates to a method for preparing a measurement sample for MALDI mass spectrometry, a device for preparing a measurement sample for MALDI mass spectrometry, a measurement sample for MALDI mass spectrometry, a MALDI mass spectrometry method, and a non-transitory recording medium for preparing a measurement sample for MALDI mass spectrometry.

Description of the Related Art

Mass spectroscopy is an analytical method where a sample containing a target molecule is ionized to separate and detect ions derived from the target molecule with a mass-to-charge ratio (m/z), and information related to identification of a chemical structure of the target molecule is obtained.

Ionization of a sample in mass spectroscopy is a factor determining the quality of analysis, and numerous methods of ionization have been developed. Examples include matrix assisted laser desorption/ionization (MALDI) and electrospray ionization (ESI). Since ionization is easily performed in these methods even with a very small amount of a sample, these methods have been used in technical fields of biotechnology and medicines.

In MALDI, pulsed laser is applied to an area of a matrix including a sample, where the matrix is a material for assisting ionization of the sample, and the sample is ionized together with the matrix.

Light having wavelengths of the ultraviolet region is often used as such pulsed laser, and light having wavelengths matched with light absorption properties of the matrix is preferable. Moreover, the matrix is a crystalline organic low-molecular-weight molecules, and needs to be co-crystalized with or formed into a mixture with the sample. It has been considered that homogeneousness or a degree of mixing of the co-crystal affects sensitivity or accuracy of analysis. Therefore, matrices have been developed correspondingly to samples.

Moreover, various methods for applying a matrix to a sample have been proposed. For example, proposed is a method for preparing a sample of mass spectroscopy where a matrix is vapor-deposited to form microcrystals, and a matrix solution is further applied onto the microcrystals by spraying to make matrix crystals grow.

SUMMARY

According to one aspect of the present disclosure, a method for preparing a measurement sample for MALDI mass spectrometry includes applying a laser beam to a base containing a matrix disposed on a surface of the base. The laser beam is applied to a surface of the base opposite to the surface on which the matrix is disposed, to make the matrix fly from the base to be disposed at a predetermined position of an analyte of MALDI mass spectrometry.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1A:
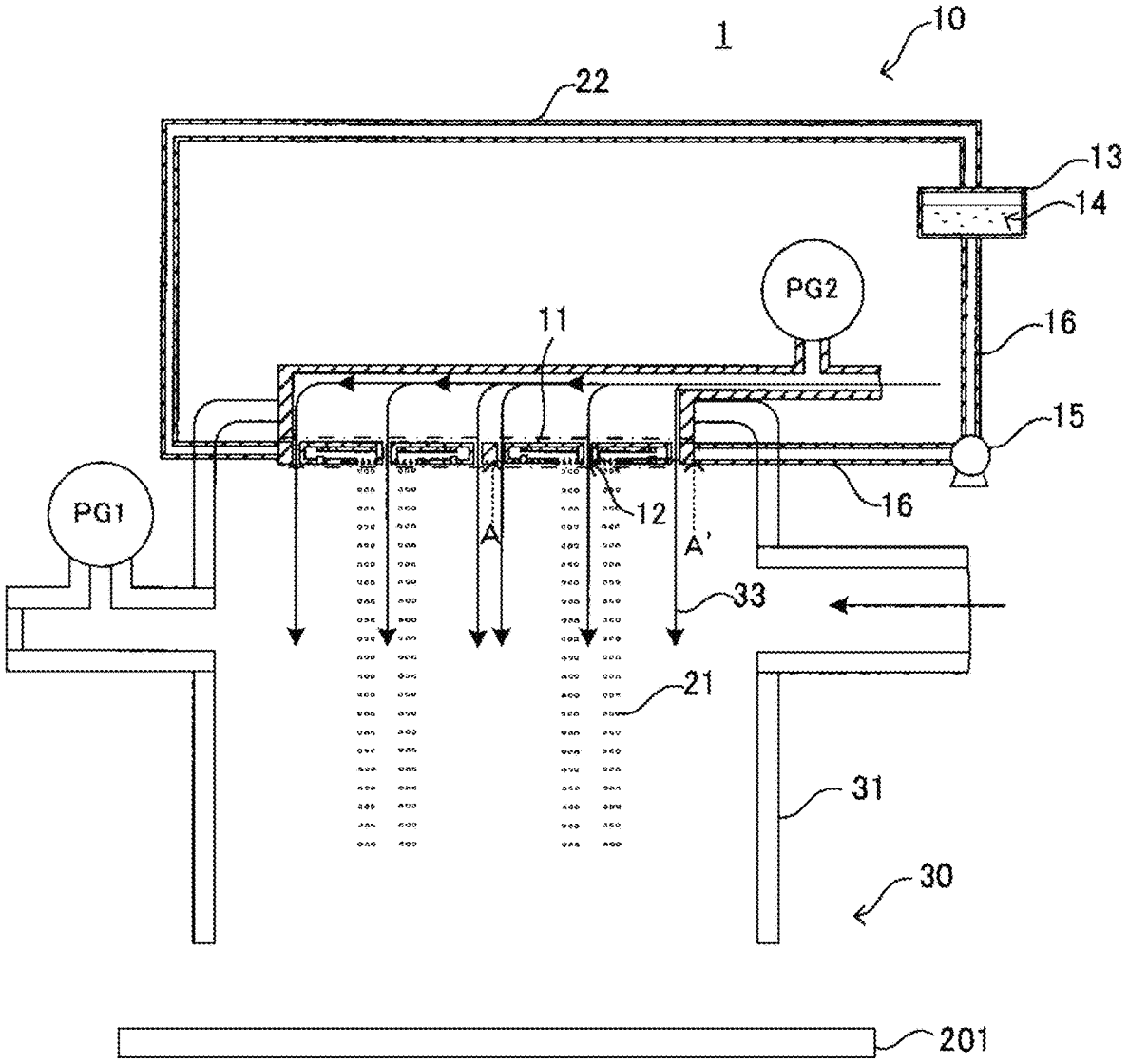
FIG. 1A is a schematic view illustrating an example of a powder forming device as a whole.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

In the present disclosure, it is possible to provide a method for preparing a measurement sample for MALDI mass spectrometry, where the method is able to dispose two or more kinds of matrices on one sample in mass spectrometry using MALDI.

(Method and Device for Preparing Measurement Sample for MALDI Mass Spectrometry)

MALDI is an abbreviation of Matrix Assisted Laser Desorption/Ionization, which is one of methods of mass spectrometry.

In mass spectroscopy using the MALDI (which is referred to as "MALDI mass spectrometry" hereinafter), mass spectroscopy is performed by applying pulsed layer to a position of a sample to which a matrix, which is a material for assisting ionization, is deposited to thereby ionize the sample together with the matrix.

The matrix for use is selected for components to be analyzed in the sample.

The method and device of the present disclosure for preparing a measurement sample for MALDI mass spectrometry have been accomplished based on the finding that only one kind of a matrix can be disposed according to methods known in the art, such as a method where a matrix is applied to a sample by a spray gun, and a method where a matrix is applied to a sample through gas-phase spray or vapor deposition. In other words, the method of the present disclosure has been accomplished based on the finding that although there are optimum matrices for components to be analyzed, the methods known in the art cannot separately apply such optimum matrices to a plurality of components to be analyzed in one sample.

The method of the present disclosure for preparing a measurement sample for MALDI mass spectrometry has been accomplished based on the finding that diameters of crystals of a matrix tend to be uneven and quantitativity is low, because mass spectroscopy of the method known in the art depends largely on skills of an operator, and therefore sensitivity or accuracy of analysis is largely affected.

The method of the present disclosure for preparing a measurement sample for MALDI mass spectrometry includes applying a laser beam to a base containing a matrix, used for preparing the measurement sample for MALDI mass spectrometry, disposed on a surface of the base, in a manner that the laser beam is applied to a surface of the base opposite to the surface on which the matrix is disposed, to make the matrix fly from the base to be disposed at a predetermined position of an analyte of MALDI mass spectrometry.

The device of the present disclosure for preparing a measurement sample for MALDI mass spectrometry is a device used for the method of the present disclosure for preparing a measurement sample for MALDI mass spectrometry. The device includes an irradiation unit configured to apply a laser beam onto a surface of a base according to the method of the present disclosure for preparing a measurement sample for MALDI mass spectrometry, and may further include other units according to the necessity.

According to the method of the present disclosure for preparing a measurement sample for MALDI mass spectrometry, even when there is only one sample, a plurality of kinds of matrices suitable for targets to be analyzed, such as a protein, a lipid, and a nucleotide, can be disposed at predetermined positions thereof. Therefore, even when there is a plurality of targets to be analyzed in one sample, the method of the present disclosure for preparing a measurement sample for MALDI mass spectrometry can perform imaging mass spectroscopy with high sensitivity for the targets to be analyzed.

<Base Containing Matrix Disposed on Surface of the Base>

The base containing a matrix disposed on a surface of the base is not particularly limited and may be appropriately selected depending on the intended purpose. Hereinafter, the "base containing a matrix disposed on a surface of the base" is referred to as a "matrix plate."

The matrix plate includes a matrix and a base.

<<Matrix>>

The matrix is not particularly limited and may be appropriately selected depending on the intended purpose, as long as the matrix is a material capable of suppressing photodecomposition and thermal decomposition of a sample and suppressing fragmentation (cleavage).

Examples of the matrix include, but are not limited to, matrices known in the art. Specific examples of the matrix include, but are not limited to, 1,8-diaminonaphthalene (1,8-DAN), 2,5-dihydroxybenzoic acid (which may be abbreviated as "DHBA" hereinafter), 1,8-anthracenedicarboxylic acid dimethyl ester, leucoquinizarin, anthrarobin, 1,5-diaminonaphthalene (1,5-DAN), 6-aza-2-thiothymine, 1,5-diaminoanthraquinone, 1,6-diaminopyrene, 3,6-diaminocarbazole, 1,8-anthracenedicarboxylic acid, norharmane, 1-pyrenepropylamine hydrochloride, 9-aminofluorene hydrochloride, ferulic acid, dithranol, 2-(4-hydroxyphenylazo)benzoic acid) (HABA), trans-2-[3-(4-tert-butylphenyl)-2-methyl-2-propenylidene]malononitrile) (DCTB), trans-4-phenyl-3-buten-2-one (TPBO), trans-3-indoleacrylic acid (IAA), 1,10-phenanthroline, 5-nitro-1,10-phenanthroline, α-cyano-4-hydroxycinnamic acid (CHCA), sinapic acid (SA), 2,4,6-trihydroxyacetophenone (THAP), 3-hydroxypicolinic acid (HPA), anthranilic acid, nicotinic acid, 3-aminoquinoline, 2-hydroxy-5-methoxybenzoic acid, 2,5-dimethoxybenzoic acid, 4,7-phenanthroline, p-coumaric acid, 1-isoquinolinol, 2-picolinic acid, 1-pyrenebutanoic acid, hydrazide (PBH), 1-pyrenebutyric acid (PBA), 1-pyrenemethylamine hydrochloride (PMA), gold, silver, platinum, and cobalt. Among the above-listed examples, matrix that is acicular-crystalizable is preferable, and for example, 2,5-dihydroxybenzoic acid (DHBA) is preferable.

As the matrix that is made fly from the matrix plate including the base in the method for preparing a measurement sample for MALDI mass spectrometry, one of the above-listed various kinds of the matrices can be selected, but the matrix is preferably two or more kinds of the matrices.

Moreover, two or more kinds of the matrices that are made fly from the matrix plate including the base are preferably disposed on mutually different predetermined positions of the sample for MALDI mass spectrometry. The above-mentioned configuration is advantageous because two or more kinds of matrices can be separately applied in one measurement sample, and two or more kinds of imaging mass spectrometry can be performed on one measurement sample.

<<Base>>

A shape, structure, size, material, and other features of the base are not particularly limited and may be appropriately selected depending on the intended purpose.

The shape of the base is not particularly limited and may be appropriately selected depending on the intended purpose, as long as the base contains a matrix on a surface thereof and a laser beam or an optical vortex laser beam can be applied onto a back surface of the base. Examples of a flat-plate base include, but are not limited to, a glass slide.

The material of the base is not particularly limited and may be appropriately selected depending on the intended purpose, as long as the material of the base transmits a laser beam or an optical vortex laser beam. Among the materials that transmit a laser beam or an optical vortex laser beam, inorganic materials, such as various glass including silicon oxide as a main component, and organic materials, such as transparent heat resistance plastics and elastomers, are preferable in view of transmittance and heat resistance.

A surface roughness Ra of the base is not particularly limited and may be appropriately selected depending on the intended purpose. The surface roughness Ra is preferably 1 μm or less both on a front surface and a back surface of the base in order to suppress refraction scattering of a laser beam or an optical vortex laser beam, and to prevent reduction in energy to be applied to the matrix. Moreover, the surface roughness Ra in the preferable range is advantageous because unevenness in an average thickness of the matrix deposited on the sample can be suppressed, and a desired amount of the matrix can be deposited.

The surface roughness Ra can be measured according to JIS B0601. For example, the surface roughness Ra can be measured by means of a confocal laser microscope (available from KEYENCE CORPORATION) or a stylus-type surface profiler (Dektak150, available from Bruker AXS).

[Production Method of Matrix Plate]

A production method of the matrix plate is not particularly limited and may be appropriately selected depending on the intended purpose. Examples of the production method include, but are not limited to, a method where a matrix crystallized by a powder forming device as described below is placed on a glass slide to produce a matrix plate.

In an exemplified production method of the matrix plate, first, a matrix solution containing a matrix mixed in a solvent is prepared.

The solvent is not particularly limited and may be appropriately selected depending on the intended purpose. Examples of the solvent include, but are not limited to, TFA, TFA-acetonitrile, THF, and methanol.

Figure 1B:
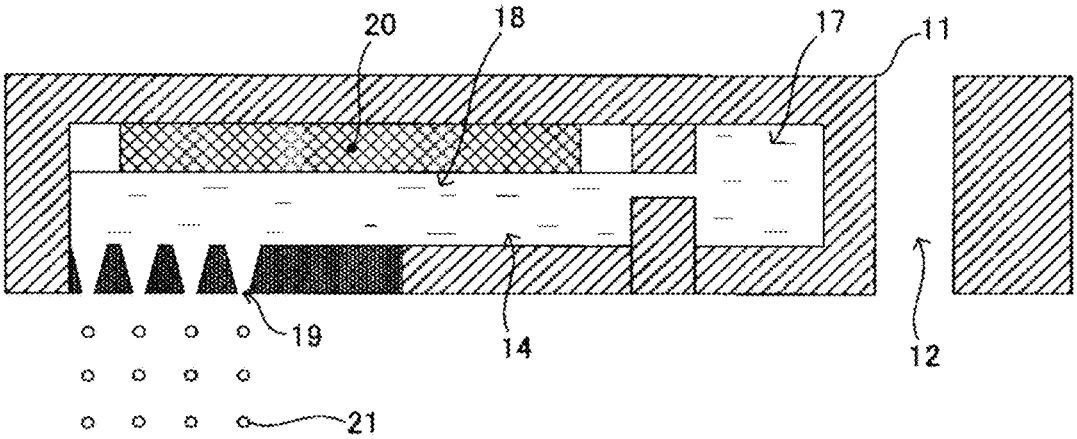
FIG. 1B is a schematic view illustrating a droplet forming head in a droplet forming unit in FIG. 1A.
Figure 1C:
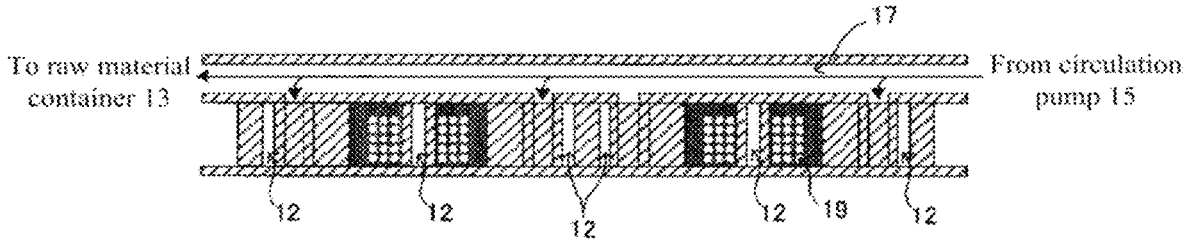
FIG. 1C is a cross-sectional view of a droplet forming unit in FIG. 1A, as taken along line A-A'.

Next, the prepared matrix solution is accommodated in a raw material container 13 of a powder forming device 1 illustrated in FIGS. 1A to 1C.

FIG. 1A is a schematic view illustrating an example of a powder forming device as a whole. FIG. 1B is a schematic view illustrating a droplet forming head in a droplet forming unit in FIG. 1A. FIG. 1C is a cross-sectional view of a droplet forming unit in FIG. 1A, as taken along line A-A'.

The powder forming device 1 illustrated in FIG. 1A includes mainly a droplet forming unit 10 and a dry collection unit 30. The droplet forming unit 10 is a liquid chamber having a liquid jetting region in communication with the outside through discharge holes, and has a plurality of droplet discharge heads 11 aligned, where the droplet discharge heads 11 are a droplet forming unit configured to jet from the discharge holes, droplets of the matrix solution inside a liquid column resonance liquid chamber in which liquid column resonance standing waves are generated under predetermined conditions. Both sides of each droplet discharge head 11 are provided with gas flow passages 12 through each of which a gas flow generated by a gas flow generating unit passes so that droplets of the matrix solution discharged from the droplet discharge head 11 are flown to the side of the dry collection unit 30. Moreover, the droplet forming unit 10 includes a raw material container 13 storing therein a matrix solution 14 that is a matrix raw material, and a liquid circulation pump 15 configured to supply the matrix solution 14 accommodated in the raw material container 13 to the below-mentioned common liquid supply path 17 inside the droplet discharge head 11 through a liquid supply tube 16, and to pump the matrix solution 14 inside the liquid supply tube 16 to return to the raw material container 13 through a liquid returning tube 22. Moreover, the droplet discharge head 11 includes the common liquid supply path 17 and a liquid column resonance liquid chamber 18, as illustrated in FIG. 1B. The liquid column resonance liquid chamber 18 is in communication with the common liquid supply path 17 provided at one of the wall surfaces at both edges in a longitudinal direction. The liquid column resonance liquid chamber 18 includes matrix discharge holes 19 disposed in one of the wall surfaces connected to the wall surfaces at both edges in the longitudinal direction and configured to discharge matrix droplets 21. The liquid column resonance liquid chamber 18 further includes a vibration generating unit 20 disposed at the wall surface facing the matrix discharge holes 19 and configured to generate high frequency vibrations for forming liquid column resonance standing waves. Note that, a high frequency power source is connected to the vibration generating unit 20.

The dry collection unit 30 illustrated in FIG. 1A includes a chamber 31 and a matrix collecting unit. Inside the chamber 31, a gas flow generated by the gas flow generating unit and a downward gas flow 33 are merged to form a large downward gas flow. Matrix droplets 21 jetted from the droplet discharge head 11 of the droplet forming unit 10 are transported downwards by the downward gas flow 33 as well as by the action of gravity, and therefore the jetted matrix droplets 21 are prevented from slowing down due to air resistance. With this configuration, variation in crystal diameters of the matrix droplets 21 is prevented, where the variation would otherwise occur when the matrix droplets 21 are continuously jetted because the traveling speed of previously jetted matrix droplets 21 is slowed down due to air resistance and subsequently jetted matrix droplets 21 catch up with the previously jetted matrix droplet 21 to cause cohesion between the matrix droplets 21. The gas flow generating unit may employ a method where pressurization is performed by disposing a blower at an upstream section or a method where decompression is performed by vacuuming by the matrix collecting unit. The matrix collecting unit includes a rotary gas flow generating device configured to generate a rotary gas flow rotating around an axis parallel to the vertical direction. Powder of the dried and crystalized matrix is born on a base 201 disposed on the bottom of the chamber 31.

The matrix powder obtained in the above-described manner has less variation in crystal diameters, and therefore analysis of high reproducibility becomes possible. Since the matrix powder includes almost no solvent as the solvent is evaporated by drying, biological tissue of the measurement sample is prevented from being destroyed by the solvent of the matrix solution applied to the sample, as seen in the methods known in the art by, for example, spraying. Since almost no solvent is evaporated in performing mass spectrometry, advantageously, the matrix powder can be used to perform mass spectrometry in medical fields or clinical trials, and analysis results can be obtained on-site.

A shape of the matrix disposed on the surface of the base is not particularly limited and may be appropriately selected depending on the intended purpose. Examples of the shape of the matrix include, but are not limited to, a single layer, a multiple layer, and dots. Among the above-listed examples, a single layer or dots, or both are preferable. The shape of the matrix being a single layer or dots, or both is advantageous because the matrix can be easily disposed on the surface of the base.

[Method for Applying Laser Beam to Matrix Plate (Laser Beam Irradiation Unit)]

A method for applying a laser beam to the matrix plate (laser beam irradiation unit) is not particularly limited and may be appropriately selected depending on the intended purpose. For example, the method is preferably a method where a laser beam is applied to the matrix plate by the below-described laser beam irradiation unit.

Figure 2:
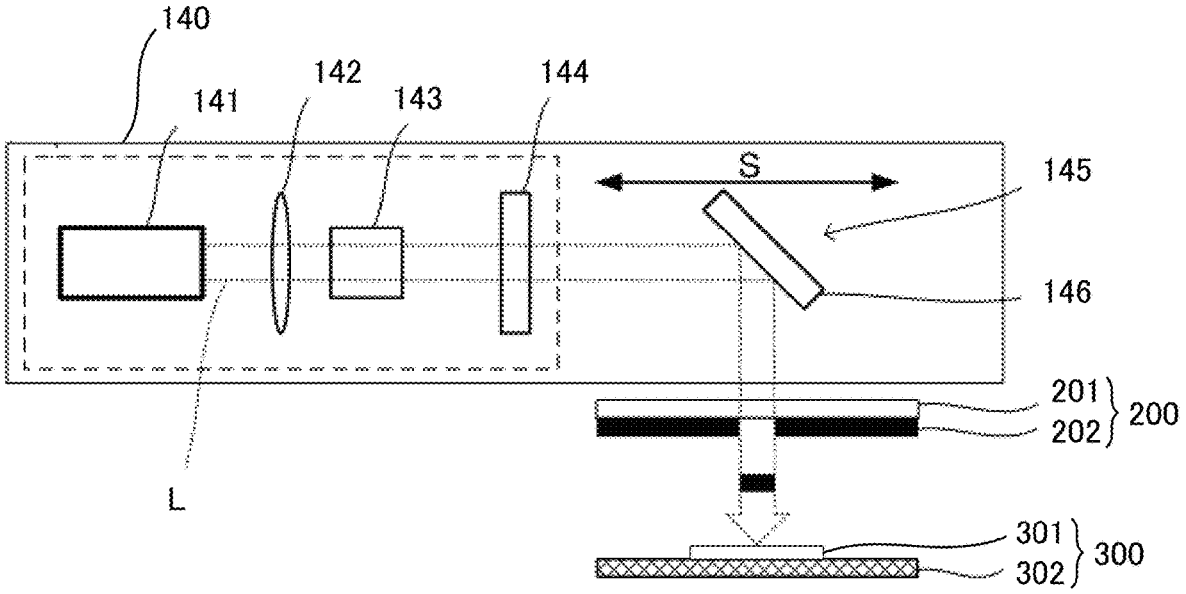
FIG. 2 is a schematic view illustrating an example of a laser beam irradiation unit that can be used in a method of the present disclosure for preparing a measurement sample for MALDI mass spectrometry.

FIG. 2 is a schematic view illustrating an example of a laser beam irradiation unit that can be used in the method of the present disclosure for preparing a measurement sample for MALDI mass spectrometry.

In FIG. 2, the laser beam irradiation unit 140 is configured to apply a laser beam L to a matrix 202 born on a base 201, and the matrix 202 is made fly by the energy of the laser beam L to deposit the matrix 202 on a sample section 301 on a glass slide 302.

The laser beam irradiation unit 140 includes a laser light source 141, a beam diameter changing unit 142, a beam wavelength changing unit 143, an energy adjusting filter 144, and a beam scanning unit 145. The matrix plate 200 includes the base 201 and the matrix 202, and the measurement sample 300 includes the sample section 301 and the glass slide 302.

The laser light source 141 is configured to generate and apply a pulse-oscillated laser beam L to the beam diameter changing unit 142.

Examples of the laser light source 141 include, but are not limited to, a solid laser, a gas laser, and a semiconductor laser.

The beam diameter changing unit 142 is disposed downstream of the laser light source 141 in an optical path of the laser beam L generated by the laser light source 141, and is configured to change the diameter of the laser beam L.

Examples of the beam diameter changing unit 142 include, but are not limited to, a condenser lens.

The beam diameter of the laser beam L is not particularly limited and may be appropriately selected depending on the intended purpose. The beam diameter is preferably 5 μm or greater but 100 μm or less. The beam diameter of the laser beam L within the preferable range is advantageous because arrangement of a matrix corresponding to a beam diameter of the existing MALDI becomes possible.

The beam wavelength changing unit 143 is disposed downstream of the beam diameter changing unit 142 in an optical path of the laser beam L, and is configured to change the wavelength of the laser beam L to a wavelength that can be absorbed by the matrix 202.

The beam wavelength changing unit is not particularly limited and may be appropriately selected depending on the intended purpose, as long as the total torque $J_{L,S}$ represented by the formula (1) below can satisfy the condition $|J_{L,S}|\geq 0$ when circular polarization is given to the laser beam. Examples of the beam wavelength changing unit include, but are not limited to, a quarter wave plate. In case of the quarter wave plate, oval circular polarization (elliptic polarization) may be given to an optical vortex laser beam by setting an optical axis to an angle other than +45° or −45°, but preferably, circular polarization of a true circle is given to an optical vortex laser beam by setting the optical axis to +45° or −45° to satisfy the condition described above. As a result, the laser beam irradiation unit 140 can increase the effect of stably making the light-absorbing material fly to deposit the light-absorbing material on the deposition target with suppressed scattering.

$$J_{L,S} = \varepsilon_0\left\{\omega LI - \frac{1}{2}\omega Sr\frac{\partial I}{\partial r}\right\} \quad (1)$$

In the formula (1), $\varepsilon_0$ is a dielectric constant in vacuum, $\omega$ is an angular frequency of light, L is a topological charge, I is an orbital angular momentum corresponding to the degree of vortex of a laser beam represented by the following mathematical formula (2), S is a spin angular momentum corresponding to circular polarization, and r is a radius vector of the cylindrical coordinates system.

$$I(r) = r^{(2|L|)}\exp\left(-\frac{r^2}{\omega_0^2}\right) \quad (2)$$

In the formula (2), $\omega_0$ is a beam waist size of light.

The topological charge is a quantum number appearing from the periodic boundary condition of the orientation direction in the cylindrical coordinates system of the laser beam. The beam waist size is the minimum value of the beam diameter of the laser beam.

L is a parameter determined by the number of turns of the spiral wavefront in the wave plate. S is a parameter determined by the direction of circular polarization in the wave plate. L and S are both integers. The symbols L and S represent directions of spiral; i.e., clockwise and anticlockwise, respectively.

When the total torque of the optical vortex laser beam is J, the relationship J=L+S is established.

Examples of the beam wavelength changing unit 143 include, but are not limited to, KTP crystals, BBO crystals, LBO crystals, and CLBO crystals.

The energy adjusting filter 144 is disposed downstream of the beam wavelength changing unit 143 in an optical path of the laser beam L, and is configured to transmit and convert the laser beam L to appropriate energy for making the matrix 202 fly. Examples of the energy adjusting filter 144 include, but are not limited to, an ND filter, and a glass plate.

The beam scanning unit 145 is disposed downstream of the energy adjusting filter 144 in an optical path of the laser beam L, and includes a reflector 146.

The reflector 146 is movable in a scanning direction presented with an arrow S in FIG. 2 by a reflector driving unit, and is configured to reflect the laser beam L to an arbitrary position of the matrix 202 born on the base 201.

The matrix 202 is irradiated with the laser beam L having passed through the energy adjusting filter 144, and receives energy in the range of the diameter of the laser beam L to fly onto the sample section 301.

The laser beam L is not particularly limited and may be appropriately selected depending on the intended purpose. Examples of the laser beam L include, but are not limited to, an optical vortex laser beam and Gaussian laser beam. Among the above-listed examples, an optical vortex laser beam is preferable because the optical vortex laser beam has such properties that can enhance robustness of conditions for transferring a sample without scattering a matrix.

The optical vortex laser beam will be described.

Figure 9A:
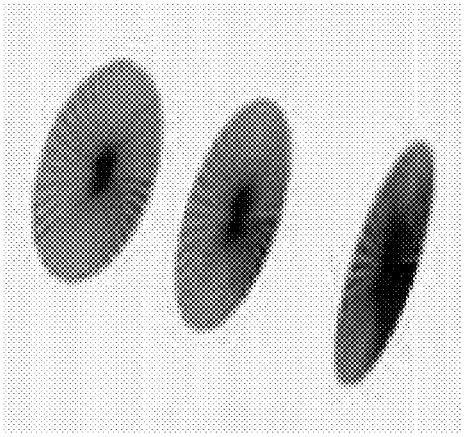
FIG. 9A is a schematic view illustrating one example of a wavefront (equiphase surface) of a typical laser beam.
Figure 9B:
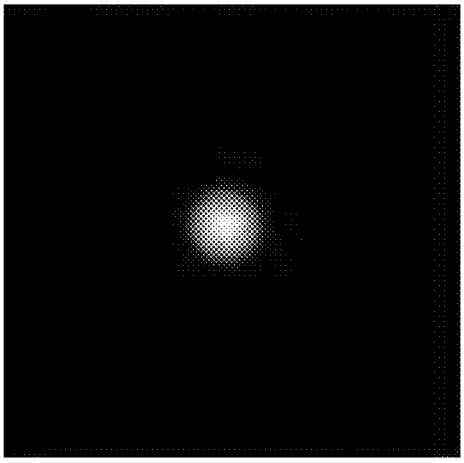
FIG. 9B is a view illustrating one example of a light intensity distribution of a typical laser beam.
Figure 9C:
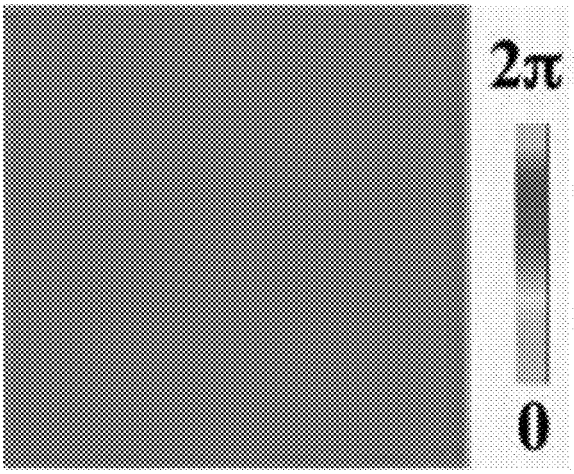
FIG. 9C is a view illustrating one example of a phase distribution of a typical laser beam.

Since a typical laser beam has uniform phases, the laser beam has a planar equiphase surface (wavefront) as depicted in FIG. 9A. The direction of the pointing vector of the laser beam is the orthogonal direction of the planar equiphase surface. Accordingly, the direction of the pointing vector of the laser beam is identical to the irradiation direction of the laser beam. When the light-absorbing material is irradiated with the laser beam, therefore, a force acts on the light-absorbing material in the irradiation direction. However, the light intensity distribution in the cross-section of the layer beam is a normal distribution (Gaussian distribution) where light intensity is the maximum at the center of the beam as depicted in FIG. 9B. Therefore, the light-absorbing material tends to be scattered. Observation of the phase distribution confirms that there is no phase difference as depicted in FIG. 9C.

Figure 10A:
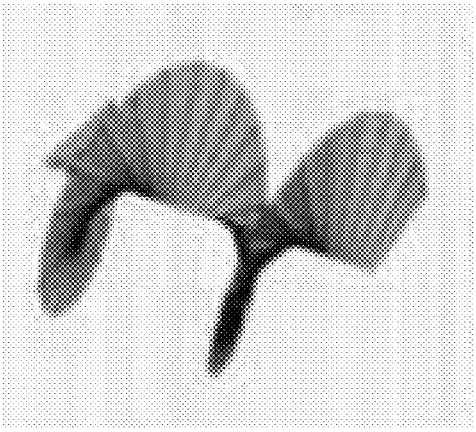
FIG. 10A is a schematic view illustrating one example of a wavefront (equiphase surface) of an optical vortex laser beam.
Figure 10B:
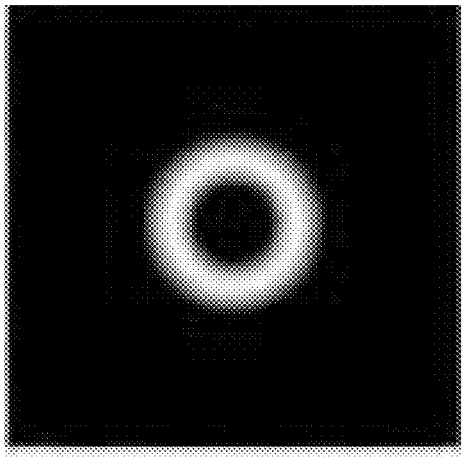
FIG. 10B is a view illustrating one example of a light intensity distribution of an optical vortex laser beam.
Figure 10C:
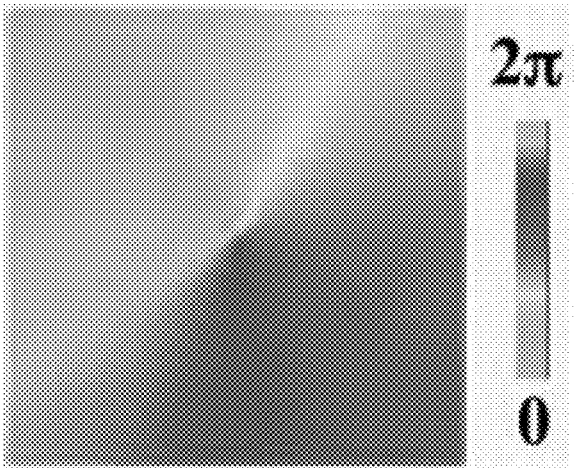
FIG. 10C is a view illustrating one example of a phase distribution of an optical vortex laser beam.

On the other hand, an optical vortex laser beam has a spiral equiphase surface as depicted in FIG. 10A. The direction of the pointing vector of the optical vortex laser beam is a direction orthogonal to the spiral equiphase surface. When the light-absorbing material is irradiated with the optical vortex laser beam, a force acts in the orthogonal direction. The light intensity distribution is a doughnut-shaped distribution where the center of the beam is 0 and recessed as depicted in FIG. 10B. The doughnut-shaped energy is applied as radiation pressure to the light-absorbing material irradiated with the optical vortex laser beam. As a result, the light-absorbing material irradiated with the optical vortex laser beam is made fly in the irradiation direction of the optical vortex laser beam and is then deposited on a deposition target with a less degree of scattering. Observation of the phase distribution confirms that a phase difference occurs as depicted in FIG. 10C.

Figure 11A:
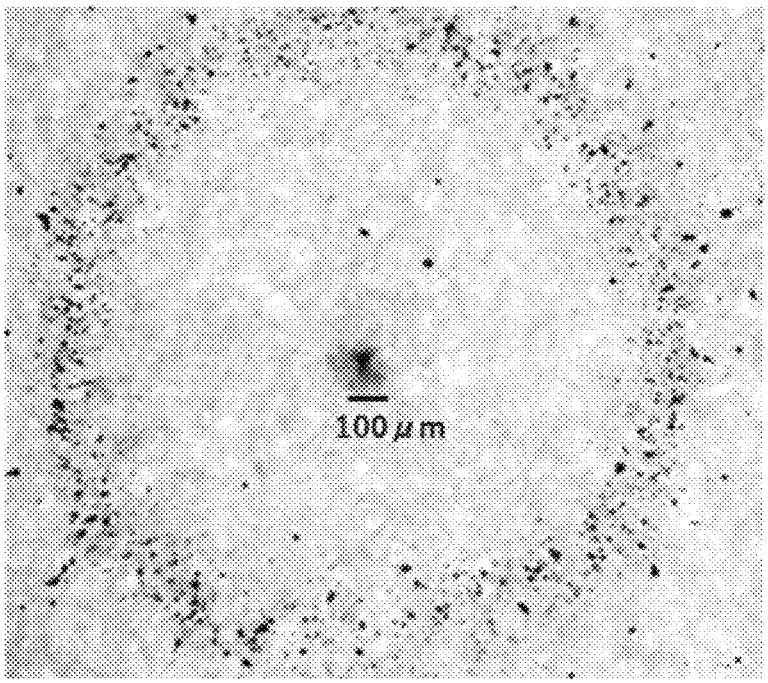
FIG. 11A is a photograph illustrating one example where a light-absorbing material is irradiated with a typical laser beam.
Figure 11B:
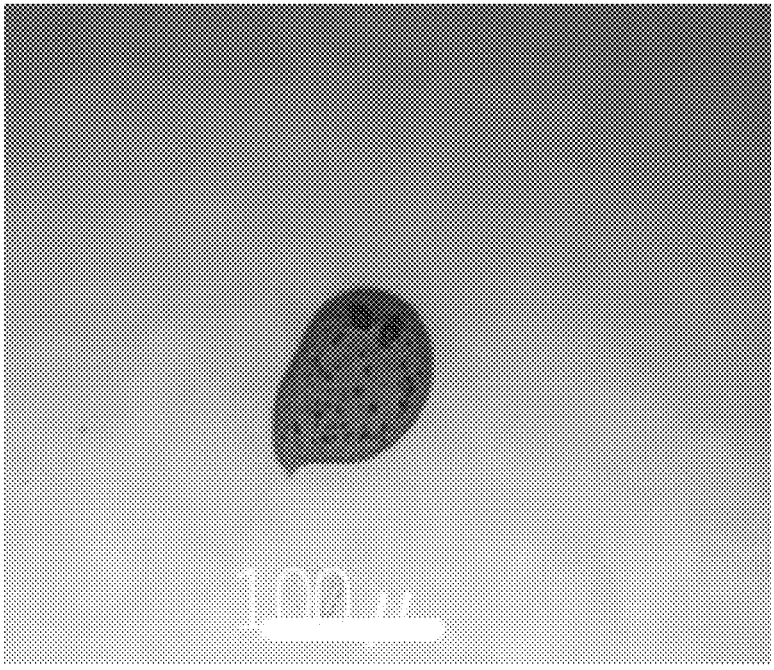
FIG. 11B is a photograph illustrating one example where a light-absorbing material is irradiated with an optical vortex laser beam.

FIG. 11A is a photograph depicting one example where a light-absorbing material is irradiated with a typical laser beam. FIG. 11B is a photograph depicting one example where a light-absorbing material is irradiated with an optical vortex laser beam.

Comparing FIG. 11A and FIG. 11B with each other, it can be confirmed that the light-absorbing material is scattered more in FIG. 11A than in FIG. 11B. This makes it possible to understand that the light-absorbing material irradiated with the optical vortex laser beam receives doughnut-shaped energy as radiation pressure to fly in the radiation direction of the optical vortex laser beam and the light-absorbing material is deposited on a deposition target with a less degree of scattering.

A method for determining whether the laser beam is an optical vortex laser beam is not particularly limited and may be appropriately selected depending on the intended purpose. Examples of the method include, but are not limited to, observation of the above-described phase distribution, and measurement of interference. The measurement of interference is typically used.

The measurement of interference can be performed using a laser beam profiler (e.g., a laser beam profiler available from Ophir-Spiricon, Inc., or a laser beam profiler available from Hamamatsu Photonics K.K.). Examples of the results of the measurement of interference are depicted in FIGS. 12A and 12B.

Figure 12A:
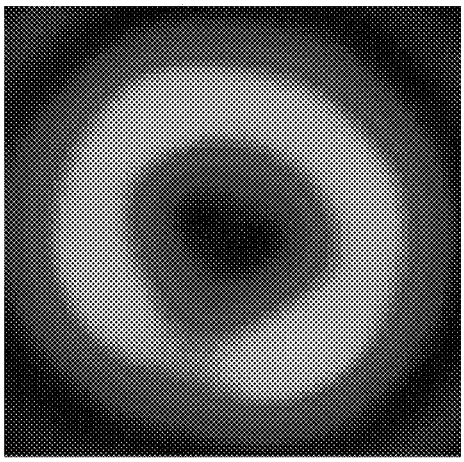
FIG. 12A is an explanatory view illustrating an example of a result of measurement of interference in an optical vortex laser beam.
Figure 12B:
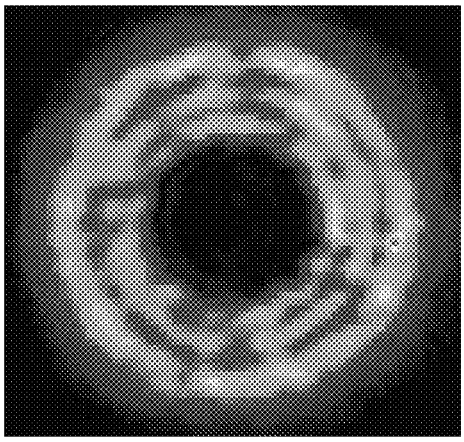
FIG. 12B is an explanatory view illustrating an example of a result of measurement of interference in a laser beam having a point of light intensity of 0 at the center thereof.

FIG. 12A is an explanatory view illustrating one example of a result of measurement of interference in an optical vortex laser beam. FIG. 12B is an explanatory view illustrating one example of a result of measurement of interference in a laser beam having a point of light intensity of 0 at the center thereof.

It can be confirmed from the measurement of interference in the optical vortex laser beam that the energy distribution is a doughnut shape as depicted in FIG. 12A, and the optical vortex laser beam is a laser beam having a point of light intensity of 0 at the center thereof, similar to FIG. 9C.

On the other hand, the measurement of interference in the typical laser beam having a point of light intensity of 0 at the center thereof gives a difference from the optical vortex laser beam. Specifically, the doughnut-shaped energy distribution of the typical laser beam is not uniform as depicted in FIG. 12B although it is similar to the energy distribution obtained by the measurement of interference in the optical vortex laser beam depicted in FIG. 12A.

The laser beam L being an optical vortex laser beam is advantageous because the flying matrix 202 is deposited on the sample section 301 while preventing the matrix 202 from being scattered to the periphery by virtue of the Gyroscopic effect given by the optical vortex laser beam.

The laser beam can be converted into the optical vortex laser beam using, for example, a diffractive optical element, a multi-mode fiber, or a liquid crystal phase modulator.

(Measurement Sample for MALDI Mass Spectrometry)

The measurement sample for MALDI mass spectrometry is not particularly limited and may be appropriately selected depending on the intended purpose, as long as the measurement sample includes an analyte of MALDI mass spectrometry and two or more kinds of matrices disposed on the analyte at predetermined positions thereof. When MALDI mass spectrometry is performed, the measurement sample for MALDI mass spectrometry is desirably placed on a conductive substrate.

The measurement sample for MALDI mass spectrometry can be prepared by making the matrix fly twice or more from the base to the predetermined positions of the analyte of MALDI mass spectrometry. Making the matrix fly twice or more from the base is advantageous because the amount of the matrix can be adjusted.

<Analyte>

The analyte of MALDI mass spectrometry is not particularly limited and may be appropriately selected depending on the intended purpose, as long as the analyte can be analyzed by MALDI mass spectrometry. Examples of the analyte include, but are not limited to, frozen brain tissue, whole animal sections, seeds, and printed images.

(MALDI Mass Spectrometry Method)

The MALDI mass spectrometry method of the present disclosure is not particularly limited and may be appropriately selected depending on the intended purpose, as long as the MALDI mass spectrometry method performs MALDI mass spectrometry using the measurement sample of the present disclosure for MALDI mass spectrometry.

The MALDI mass spectrometry method can be performed by, for example, MALDI-TOF-MS (available from Bruker Daltonics).

(Non-Transitory Recording Medium for Preparing Measurement Sample for MALDI Mass Spectrometry)

A non-transitory recording medium of the present disclosure for preparing a measurement sample for MALDI mass spectrometry is a non-transitory recording medium storing a plurality of instructions which, when executed by one or more processors, cause the processors to perform a method including, based on position information of an analyte of MALDI mass spectrometry, applying a laser beam to a base containing a matrix disposed on a surface of the base, in a manner that the laser beam is applied to a surface of the base opposite to the surface on which the matrix is disposed, to make the matrix fly from the base to be disposed at a predetermined position of the analyte of MALDI mass spectrometry.

The non-transitory recording medium of the present disclosure for preparing a measurement sample for MALDI mass spectrometry is preferably used to perform the method of the present disclosure for preparing a measurement sample for MALDI mass spectrometry.

Specifically, the non-transitory recording medium of the present disclosure for preparing a measurement sample for MALDI mass spectrometry can execute the method of the present disclosure for preparing a measurement sample for MALDI mass spectrometry using, for example, a computer as a hardware resource. The method of the present disclosure for preparing a measurement sample for MALDI mass spectrometry may be executed by one or more computers or servers, or both thereof.

A process by the non-transitory recording medium of the present disclosure for preparing a measurement sample for MALDI mass spectrometry is performed in the state where a plurality of matrix plates on which mutually different kinds of matrices are disposed are set in predetermined positions in advance, and an ITO-coated glass slide on which a measurement sample is placed is fixed in a predetermined position.

Figure 3A:
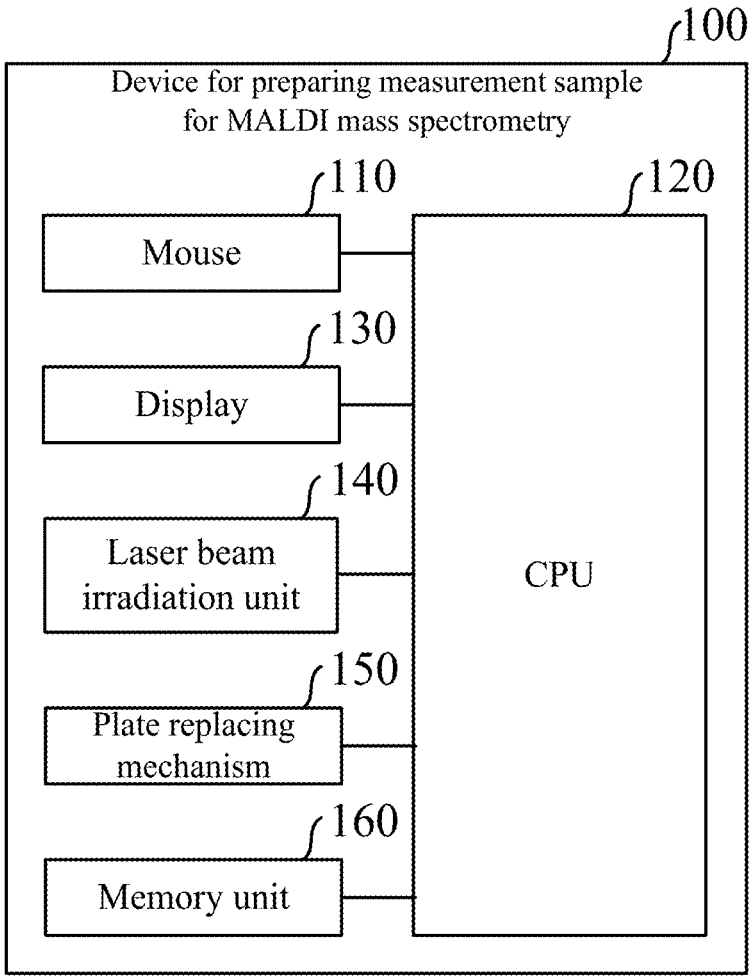
FIG. 3A is a block diagram illustrating an example of hardware of a device for preparing a measurement sample for MALDI mass spectrometry.
Figure 3B:
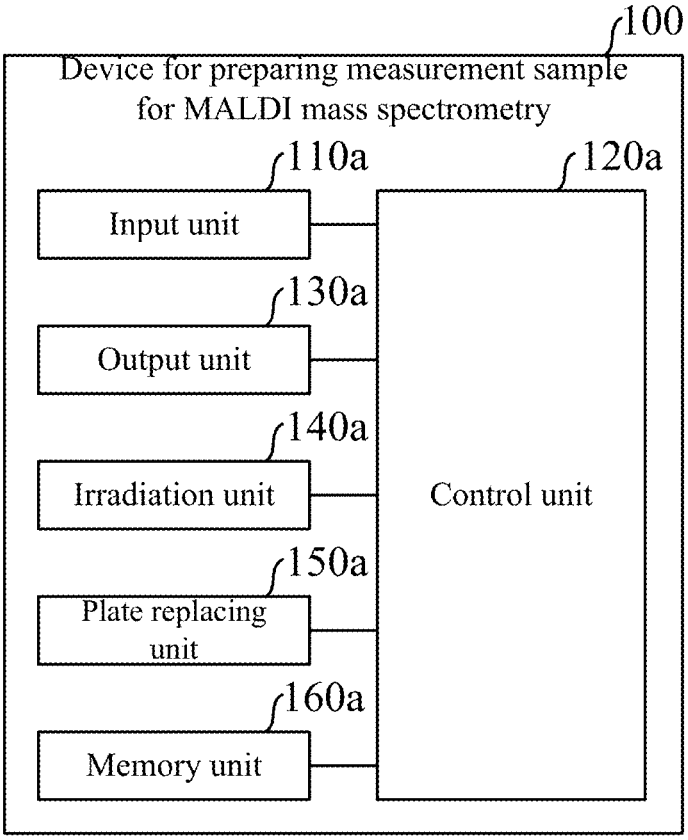
FIG. 3B is a block diagram illustrating an example of a function of the device for preparing a measurement sample for MALDI mass spectrometry.

The process by the non-transitory recording medium of the present disclosure for preparing a measurement sample for MALDI mass spectrometry can be executed, for example, by a device for preparing a measurement sample for MALDI mass spectrometry as illustrated in FIGS. 3A and 3B.

FIG. 3A is a block diagram illustrating an example of hardware of a device for preparing a measurement sample for MALDI mass spectrometry.

As illustrated in FIG. 3A, a device 100 for preparing a measurement sample for MALDI mass spectrometry includes a mouse 110, a CPU 120, a display 130, a laser beam irradiation unit 140, a plate replacing mechanism 150, and a memory unit 160. The CPU 120 is coupled with each unit.

The mouse 110 is configured to receive irradiation data corresponding information of "a kind of a matrix" to information of "a position of a measurement sample irradiated with a laser beam" from a user with the below-described input unit 110*a*. The mouse 110 is configured to receive another input for the device 100 for preparing a measurement sample for MALDI mass spectrometry.

The CPU 120 is one kind of a processer and is a processing device configured to perform various controls and calculations. The CPU 120 realizes various functions, as the CPU 120 executes, for example, firmware stored in, for example, the memory unit 160. The CPU 120 corresponds to the below-described control unit 120*a*.

The display 130 is configured to display a screen to receive various instructions with the below-described output unit 130*a*.

The laser beam irradiation unit 140 is similar to, for example, the laser beam irradiation unit illustrated in FIG. 2, and can apply a laser beam to a predetermined position of the matrix plate with the below-described output unit 130*a*.

The plate replacing mechanism 150 is a mechanism configured to replace matrix plates, on which various matrices are disposed, stored in the device with the below-described plate replacing unit 150*a*.

The memory unit 160 stores various programs for operating the device 100 for preparing a measurement sample for MALDI mass spectrometry.

FIG. 3B is a block diagram illustrating an example of a function of the device for preparing a measurement sample for MALDI mass spectrometry.

As illustrated in FIG. 3B, the device 100 for preparing a measurement sample for MALDI mass spectrometry includes an input unit 110*a*, a control unit 120*a*, an output unit 130*a*, an irradiation unit 140*a*, a plate replacing unit 150*a*, and a memory unit 160*a*. The control unit 120*a* is coupled with each unit.

The input unit 110*a* is configured to, following the instructions of the control unit 120*a*, receive irradiation data corresponding information of "a kind of a matrix" to information of "a position of a measurement sample irradiated with a laser beam" from a user with the mouse 110.

The receipt of the irradiation data may be performed by, for example, inputting a kind of a matrix and an irradiation position on an image that captures the measurement sample placed on the ITO-coated glass slide.

The input unit 110*a* is configured to receive another input from a user.

The control unit 120*a* is configured to store irradiation data received by the input unit 110*a* in a memory unit 160*a*. The control unit 120*a* is configured to control operations of the entire device 100 for preparing a measurement sample for MALDI mass spectrometry.

The output unit 130*a* is configured to display a screen to receive various instructions on the display 130, following the instructions of the control unit 120*a*.

The irradiation unit 140*a* is configured to operate the laser beam irradiation unit 140, following the instructions of the control unit 120*a*, and can apply a laser beam to a matrix plate disposed by the plate replacing unit 150*a*.

The plate replacing unit 150*a* is configured to replace a matrix plate, following the instructions of the control unit 120*a* based on the irradiation data. The device stores therein a plurality of matrix plates on which mutually different kinds of matrix powder are disposed. The matrix plates are replaced by the plate replacing mechanism 150.

The memory unit 160*a* is configured to, following the instructions of the control unit 120*a*, store, for example, irradiation data received by the input unit 110*a* or various programs in the memory unit 160.

Figure 3C:
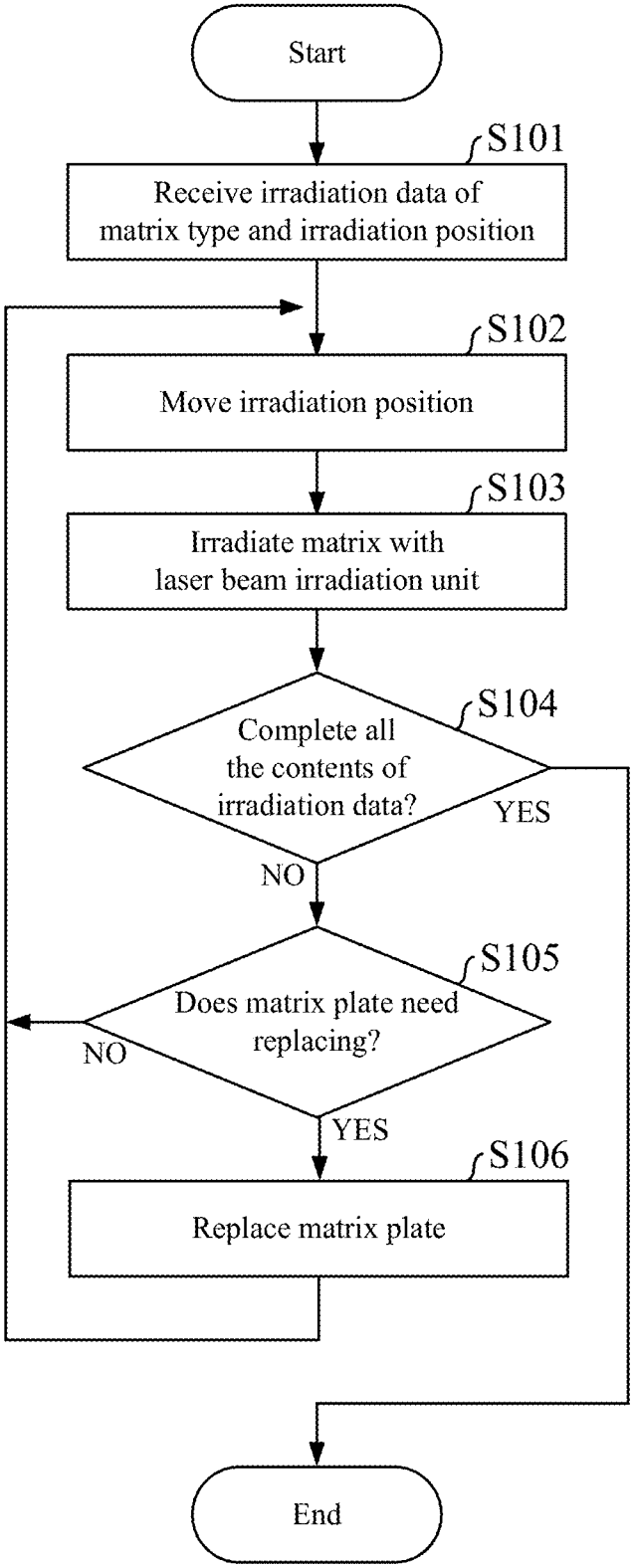
FIG. 3C is a flowchart illustrating an example of a procedure executed by a non-transitory recording medium of the present disclosure for preparing a measurement sample for MALDI mass spectrometry.

FIG. 3C is a flowchart illustrating an example of a procedure executed by the non-transitory recording medium of the present disclosure for preparing a measurement sample for MALDI mass spectrometry.

In Step S101, the input unit 110*a* receives irradiation data corresponding information of "a kind of a matrix" to information of "a position of a measurement sample irradiated with a laser beam" from a user with the mouse 110, and then moves the process to S102.

In Step S102, the control unit 120*a* moves an irradiation position of the laser beam irradiation unit 140 based on the irradiation data, and then moves the process to S103.

In Step S103, the irradiation unit 140*a* irradiates a matrix disposed on the matrix plate to dispose the matrix on a sample section with the laser beam irradiation unit 140, and then moves the process to S104.

In Step S104, the control unit 120*a* determines whether all of the contents of the irradiation data have been completed. When determining that all of the contents of the irradiation data have been completed, the control unit 120*a* ends the process. When determining that not all of the contents of the irradiation data have been completed, the control unit 120*a* moves the process to S105.

In Step S105, the control unit 120*a* determines whether it is necessary to replace the matrix plate based on the irradiation data. When determining that replacement of the matrix plate is necessary, the control unit 120*a* moves the process to S106. When determining that replacement of the matrix plate is unnecessary, the control unit 120*a* returns the process to S102.

In Step S106, the plate replacing unit 150*a* replaces the matrix plate and then returns the process to S102.

As described above, the non-transitory recording medium of the present disclosure for preparing a measurement sample for MALDI mass spectrometry stores a plurality of instructions which, when executed by one or more processors, cause the processors to perform a method including, based on position information of an analyte of MALDI mass spectrometry, applying a laser beam to a base containing a matrix disposed on a surface of the base, in a manner that the laser beam is applied to a surface of the base opposite to the surface on which the matrix is disposed, to make the matrix fly from the base to be disposed at a predetermined position of the analyte of MALDI mass spectrometry.

EXAMPLES

The present disclosure will be described below by way of Examples. The present disclosure should not be construed as being limited to these Examples.

The following presents Examples and Reference Example, in which a pulse-oscillated optical vortex laser beam is applied to Matrix A and Matrix B by the laser beam irradiation unit 140 illustrated in FIG. 2 to dispose dots of these two kinds of matrices on one sample section.

Example 1

[Preparation of Matrix Solution]

First, equal amounts of 0.1% by volume TFA (available from Thermo Fisher Scientific K.K.) and 0.1% by volume TFA-acetonitrile (available from Thermo Fisher Scientific K.K.) were mixed to be used as a solvent, and a saturated solution of sinapic acid (Matrix A) was prepared as Matrix Solution A.

Next, 10 mg/mL dithranol (Matrix B) using THF (available from Tokyo Chemical Industry Co., Ltd.) as a solvent was prepared as Matrix Solution B.

[Production of Two Kinds of Matrix Plates]

Figure 4A:
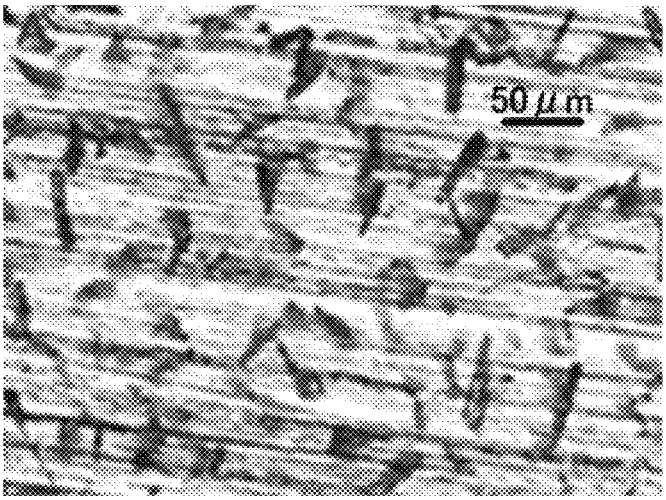
FIG. 4A is a photograph depicting Matrix Plate A in Examples.

The prepared Matrix Solution A was formed into powder of Matrix A having an average primary particle diameter of 100 μm using the powder forming technology illustrated in FIGS. 1A to 1C. A powder layer of Matrix A was formed on a surface of a glass slide (S2441, Super frost white, available from Matsunami Glass Ind., Ltd.) serving as a base to give an average thickness of 100 μm. In this manner, Matrix Plate A depicted in the photograph of FIG. 4A was produced.

Figure 4B:
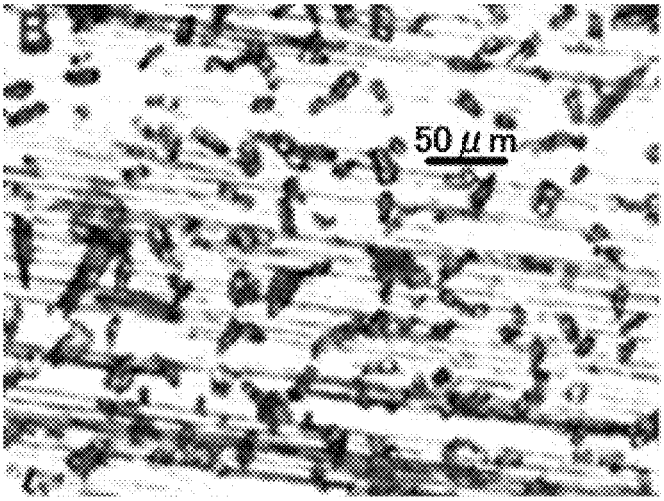
FIG. 4B is a photograph depicting Matrix Plate B in Examples.

Powder of Matrix B having an average primary particle diameter of 20 μm was formed in the same manner as in Matrix Plate A, except that Matrix Solution A was replaced with Matrix Solution B. A powder layer of Matrix B was formed on a surface of a glass slide (S2441, Super frost white, available from Matsunami Glass Ind., Ltd.) serving as a base to give an average thickness of 100 μm. In this manner, Matrix Plate B depicted in the photograph of FIG. 4B was produced.

[Production of Sample Section]

First, frozen mouse brain tissue (obtained from COSMO BIO CO., LTD.) was placed as a sample in an Eppendorf tube. The sample was crushed by the addition of beads for crushing with a multi-beads shocker (MB2000, available from Yasui Kikai Corporation). Thereafter, the entire Eppendorf tube was cooled to −196° C. with liquid nitrogen, and the sample was crushed again.

Figure 5:
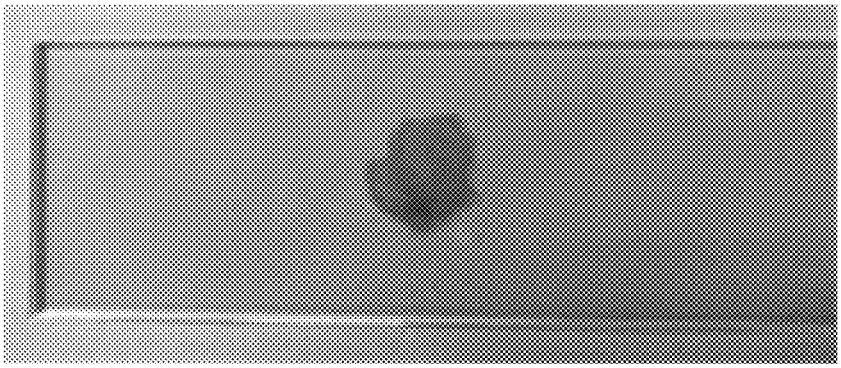
FIG. 5 is a photograph depicting a state where a sample section is placed on an ITO-coated glass plate in Examples.

Next, the beads for crushing in the Eppendorf tube were taken out with a dedicated magnet. The sample was thawed at room temperature, followed by spinning down by means of a table-top centrifuge (MCF-2360, available from LMS Co., Ltd.). Then, the Eppendorf tube was left to stand for 3 hours in liquid nitrogen to re-freeze the sample completely. The re-frozen sample was cut with a cryomicrotome to produce a sample section having an average thickness of 10 The sample section was placed on an ITO-coated glass slide (no MAS coating, 100Ω, available from Matsunami Glass Ind., Ltd.), as illustrated in FIG. 5.

[Preparation of Laser Beam Irradiation Unit]

As a laser beam irradiation unit, the laser beam irradiation unit 140 illustrated in FIG. 2 was used.

Specifically, as a laser beam source, a YAG laser configured to excite YAG crystals to oscillate laser was used. The laser beam source was used to generate a one-pulse laser beam having a wavelength of 1,064 nm, a beam diameter of 1.25 mm×1.23 mm, a pulse width of 2 nano seconds, and a pulse frequency of 20 Hz. The generated one-pulse laser beam was applied to a condenser lens (YAG laser condenser lens, available from SIGMAKOKI CO., LTD.) serving as a beam diameter changing member to adjust a beam diameter of the laser beam to be applied to a matrix to 80 μm×80 μm. The laser beam having passed through the beam diameter changing member was applied to an LBO crystal (available from CESTEC) serving as the beam wavelength changing element to change the wavelength from 1,064 nm to 532 nm. Moreover, a laser beam of 1,064 nm and a laser beam of 532 nm were converted into a laser beam of 355 nm using the LBO crystal by means of a wavelength changing member configured to perform sum-frequency generation. Next, the laser beam converted by the wavelength changing unit was passed through a vortex phase plate (Vortex phase plate, available from Luminex Corporation) to convert into an optical vortex laser beam. Next, the optical vortex laser beam converted by the vortex phase plate was passed through a quarter wave plate (QWP, available from Kogakugiken Corp.) disposed downstream of the vortex phase plate. The optical axis of the vortex phase plate and the optical axis of the quarter wave plate were set to +45' so that the total torque J represented by Formula (1) would be 2. The converted optical vortex laser beam was passed through an energy adjusting filter (ND filter, available from SIGMAKOKI CO., LTD.) so that the laser output at the time of irradiation of a matrix was adjusted to 50 μJ/dot.

[Preparation of Measurement Sample for MALDI Mass Spectrometry]

First, the powder layer of Matrix A formed on the surface of Matrix Plate A was disposed to face the sample section on the ITO-coated glass slide so that an optical vortex laser beam could be applied vertically to the back surface of Matrix Plate A with the laser beam irradiation unit. The gap between the sample section and the powder layer of Matrix A was set to 500 μm.

Figure 6A:
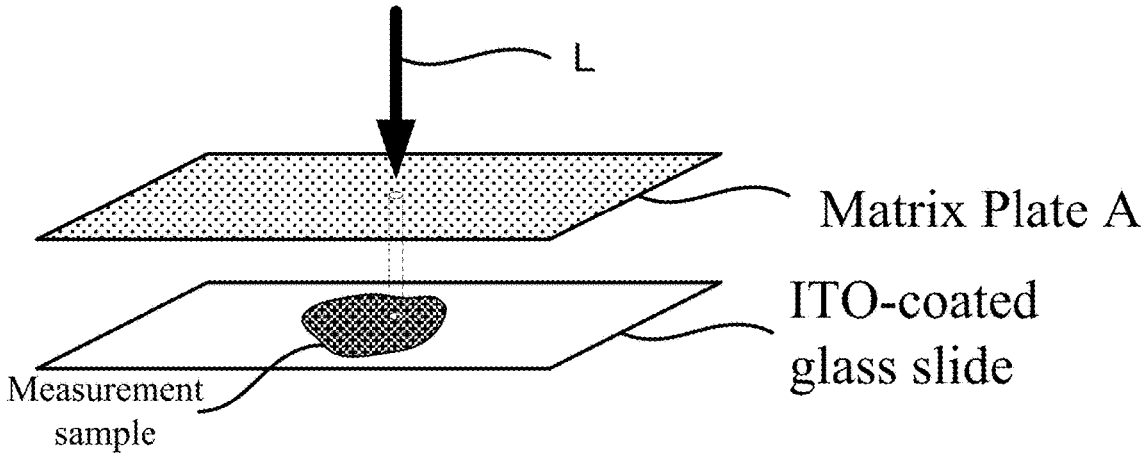
FIG. 6A is a schematic view illustrating preparation of a measurement sample for MALDI mass spectrometry in Examples.

Next, as illustrated in FIG. 6A, an optical vortex laser beam L was applied vertically to the back surface of Matrix Plate A to make the powder of Matrix A fly from Matrix Plate A to be disposed at predetermined positions of the sample section.

Figure 6B:
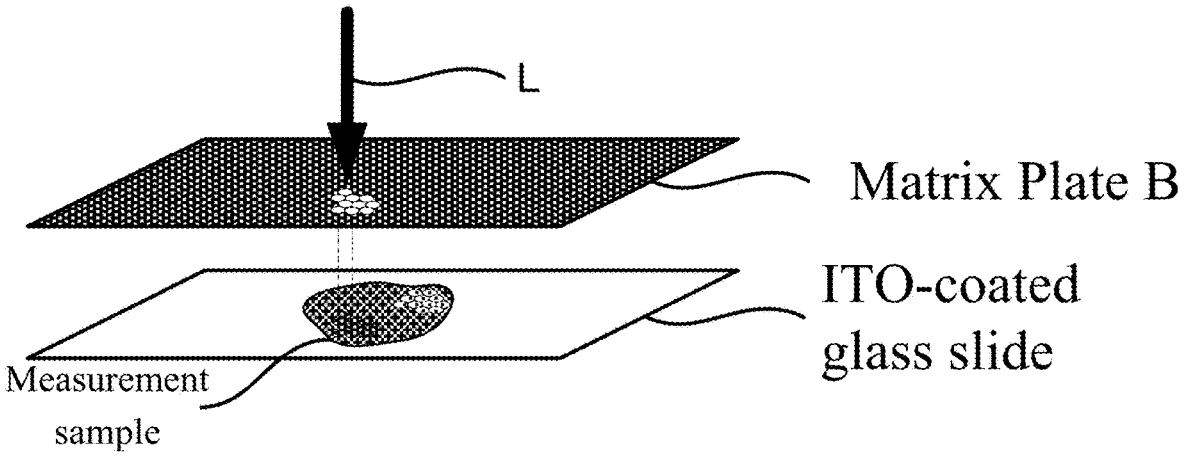
FIG. 6B is a schematic view illustrating preparation of a measurement sample for MALDI mass spectrometry in Examples.
Figure 13A:
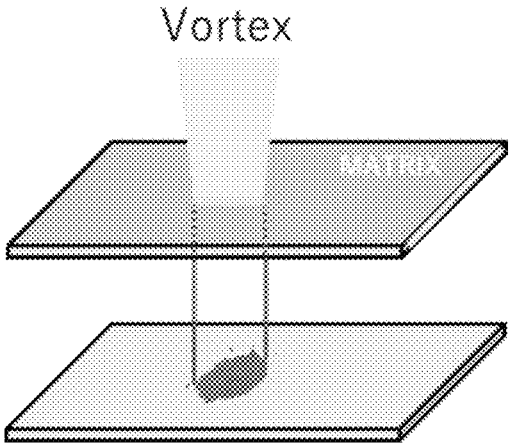
FIG. 13A is a conceptual view illustrating a method for preparing a measurement sample for MALDI mass spectrometry in Examples 1 and 2.
Figure 13B:
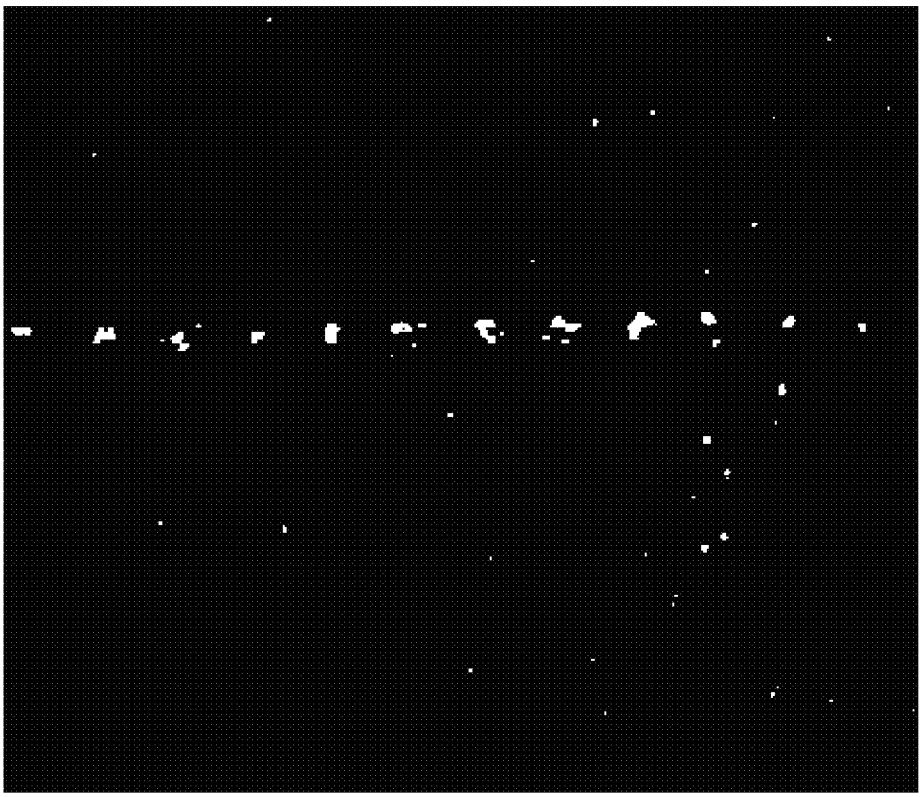
FIG. 13B is a view illustrating an example of a binarized image of an optical microscopic photograph illustrating a result obtained by using a method for preparing a measurement sample for MALDI mass spectrometry in Example 1.

After replacing Matrix Plate A with Matrix Plate B, the optical vortex laser beam L was applied vertically to the back surface of Matrix Plate B to make the powder of Matrix B fly from Matrix Plate B to be disposed at predetermined positions of the sample section on which Matrix A had not been disposed, as illustrated in FIG. 6B. In this manner, a measurement sample for MALDI mass spectrometry was prepared. FIG. 13A is a conceptual view illustrating the method for preparing a measurement sample for MALDI mass spectrometry using the optical vortex laser beam in Example 1. FIG. 13B is a view illustrating one example of a binarized image of the optical microscopic photograph illustrating the result using the method for preparing a measurement sample for MALDI mass spectrometry in Example 1. As illustrated in FIGS. 13A and 13B, use of the optical vortex laser beam could transfer Matrix B in an area almost the same as the irradiation range.

[MALDI Mass Spectrometry]

Using MALDI-TOF-MS (available from Bruker Daltonics), MALDI mass spectrometry was performed on the measurement sample for MALDI mass spectrometry in which two kinds of matrix powder were disposed.

In MALDI mass spectrometry, the range of the mass-to-charge ratio (m/z) detected with a positive ion detection mode was set to from 250 through 600, and a spectrum obtained by creating data points of 20 points in vertical by 20 points in horizontal within a spot having a diameter of about 1 mm was averaged.

Figure 7A:
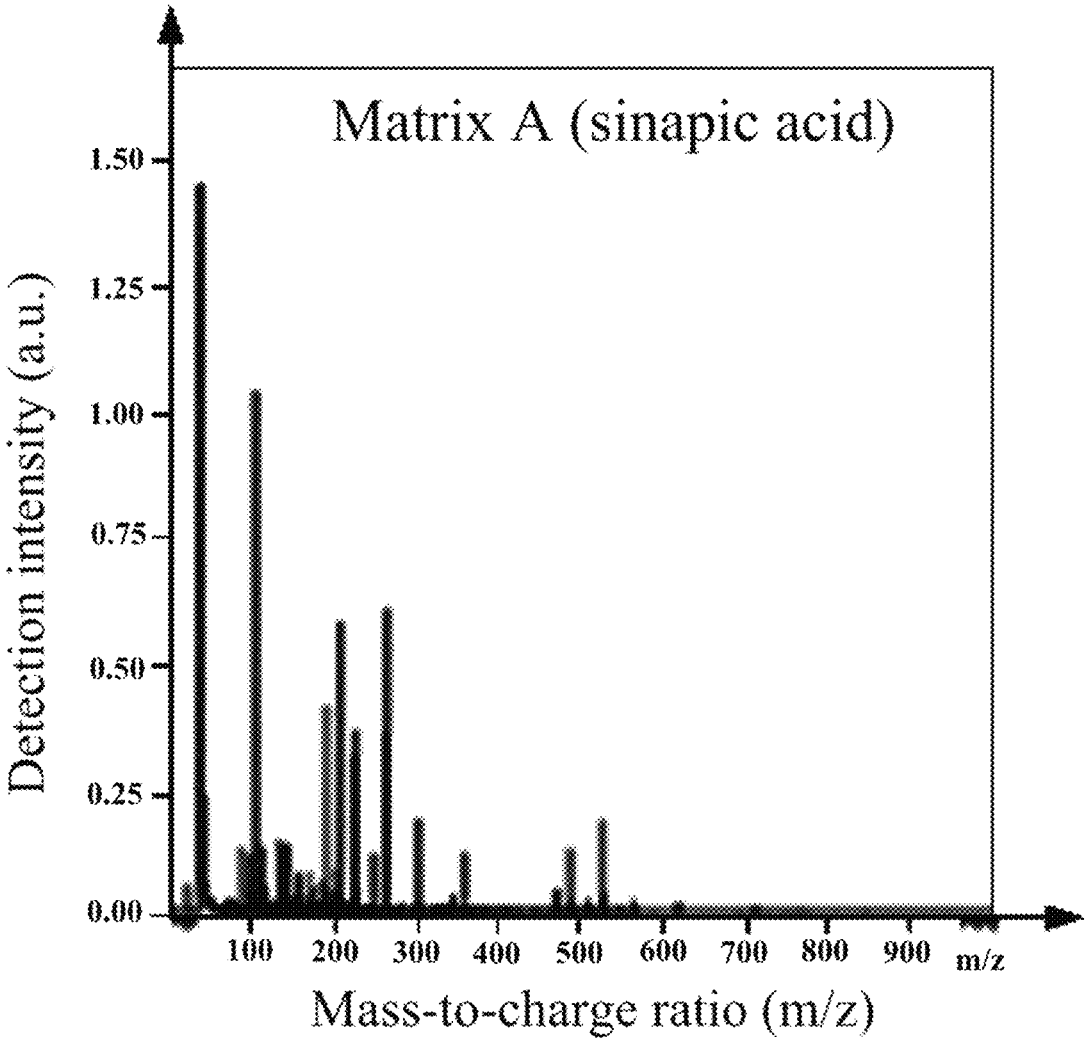
FIG. 7A is a graph depicting a spectrum obtained using Matrix A, as a result of MALDI mass spectrometry in Example.
Figure 7B:
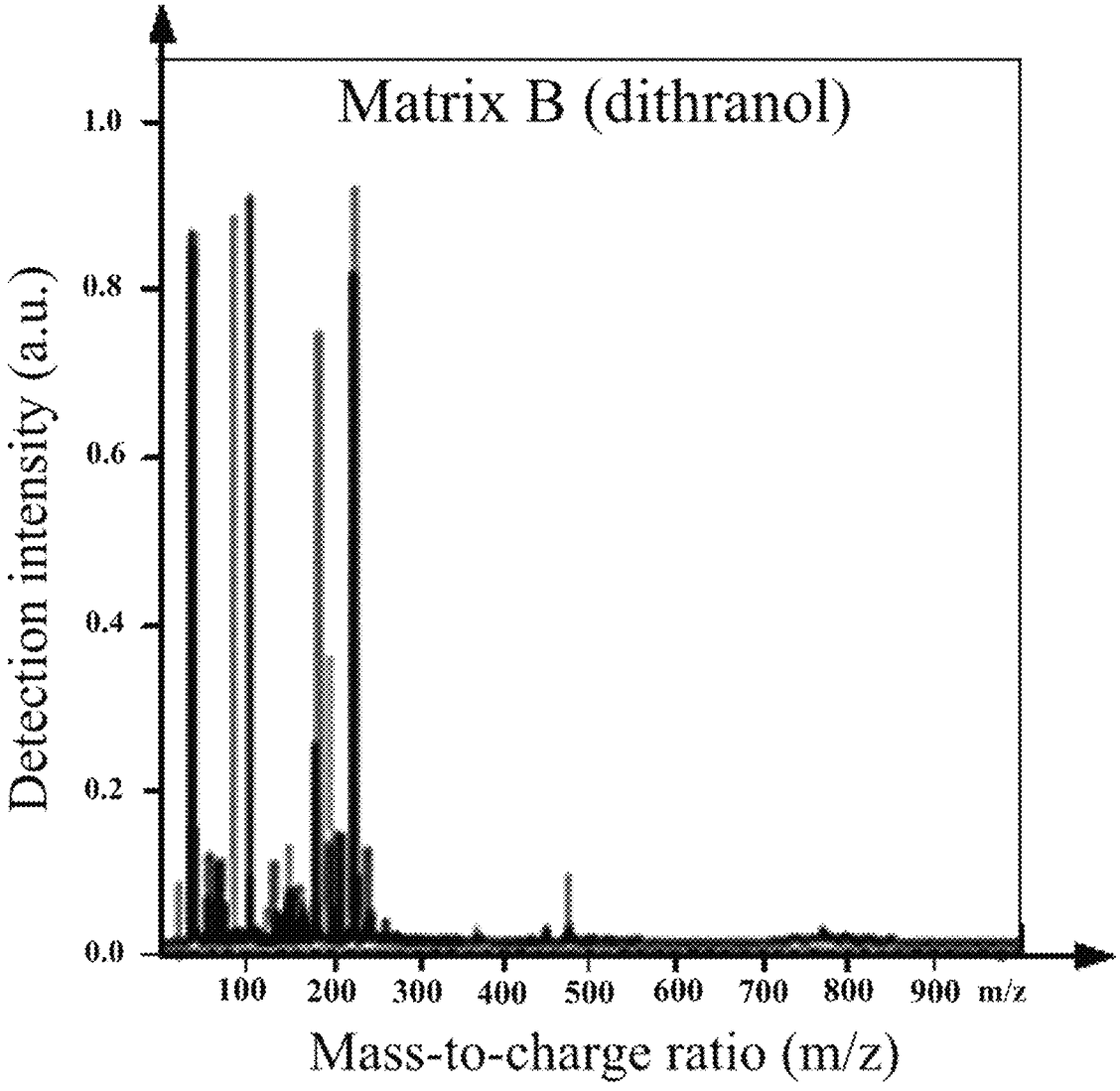
FIG. 7B is a graph depicting a spectrum obtained using Matrix B, as a result of MALDI mass spectrometry in Example.

As the result of MALDI mass spectrometry, the spectrum using Matrix A (sinapic acid) is presented in FIG. 7A, and the spectrum using Matrix B (dithranol) is presented in FIG. 7B.

As presented in FIGS. 7A and 7B, the results indicate that different detection components depending on different kinds of matrices were obtained from the same measurement sample for MALDI mass spectrometry. According to the existing coating method of a matrix, such as spraying and vapor deposition, only one kind of a matrix can be used for one sample section, and therefore the results as described above cannot be obtained. Moreover, the detection intensity of dithranol is about 60 times the detection intensity of sinapic acid. In the case where one matrix is used in the same sample, therefore, detection of sinapic acid is difficult.

Example 2

A measurement sample for MALDI mass spectrometry was produced in the same manner as in Example 1, except that the wavelength of the laser beam source for use was changed to 532 nm, and the laser beam was changed to a laser beam having a wavelength of 355 nm using a wavelength changing unit configured to perform sum-frequency generation.

As a result, the sample was produced in the same manner as in Example 1 with the same device of Example 1 except for excluding the mechanism to change the wavelength of the laser beam from 1,064 nm to 532 nm using the LBO crystal (available from CESTEC) serving as the beam wavelength changing element.

Example 3

A measurement sample for MALDI mass spectrometry was produced in the same manner as in Example 1, except that the Gaussian laser beam was used without allowing the laser beam to pass through the vortex phase plate (Vortex phase plate, available from Luminex Corporation).

Figure 14A:
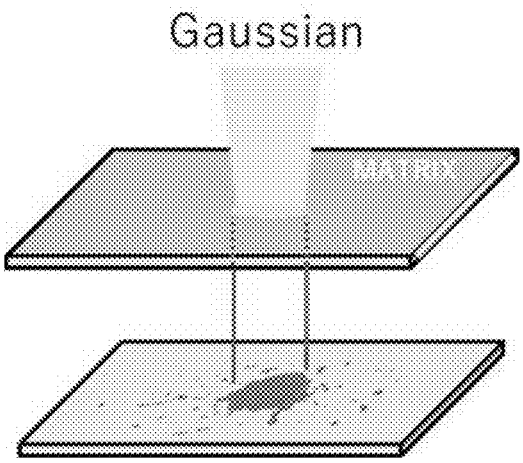
FIG. 14A is a conceptual view illustrating a method for preparing a measurement sample for MALDI mass spectrometry in Example 3.
Figure 14B:
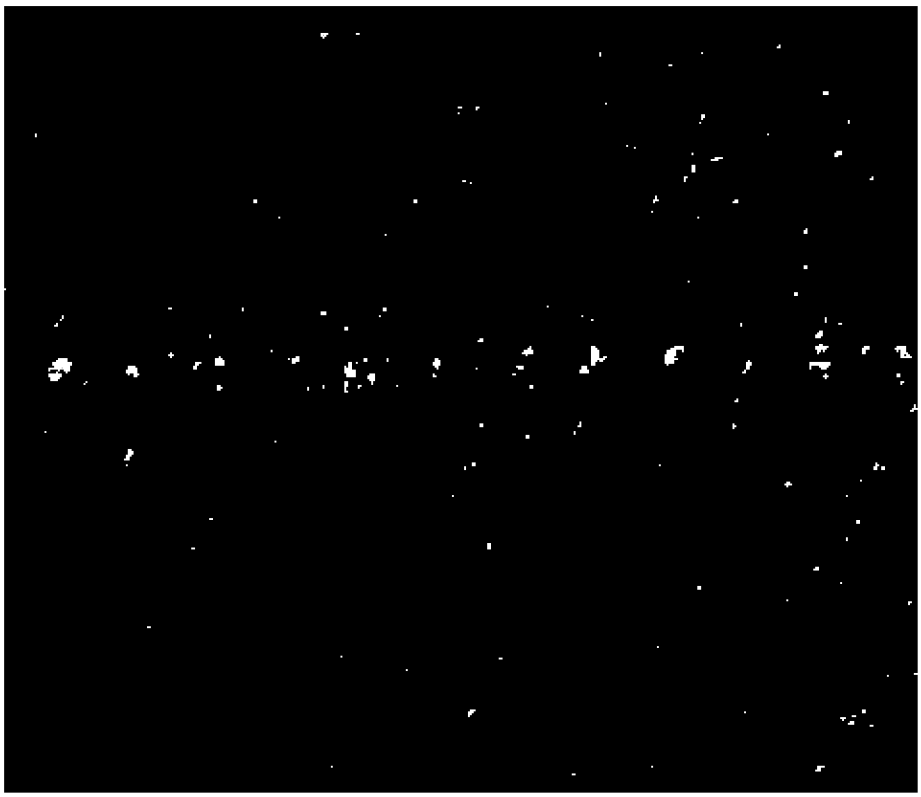
FIG. 14B is a view illustrating one example of a binarized image of the optical microscopic photograph depicting a result obtained by using a method for preparing a measurement sample for MALDI mass spectrometry and using a Gaussian laser beam in Example 3.

FIG. 14A is a conceptual view illustrating the method for preparing a measurement sample for MALDI mass spectrometry using the Gaussian laser beam in Example 3. FIG. 14B is a view illustrating one example of a binarized image of the optical microscopic photograph depicting the result obtained by using the method for preparing a measurement sample for MALDI mass spectrometry and using the Gaussian laser beam in Example 3. As illustrated in FIGS. 14A and 14B, use of the Gaussian laser beam could also prepare the measurement sample for MALDI mass spectrometry without any problem.

Figure 15A:
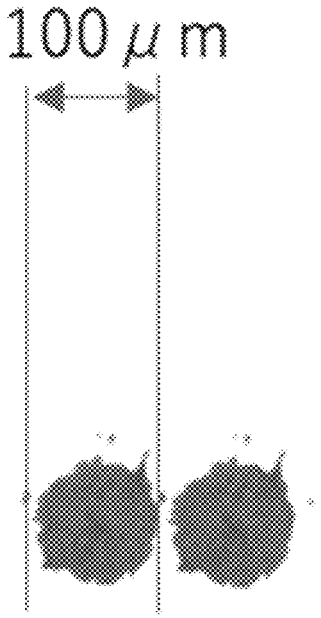
FIG. 15A is a view illustrating one example of a microscopic image of a sample transferred using an optical vortex laser beam.
Figure 15B:
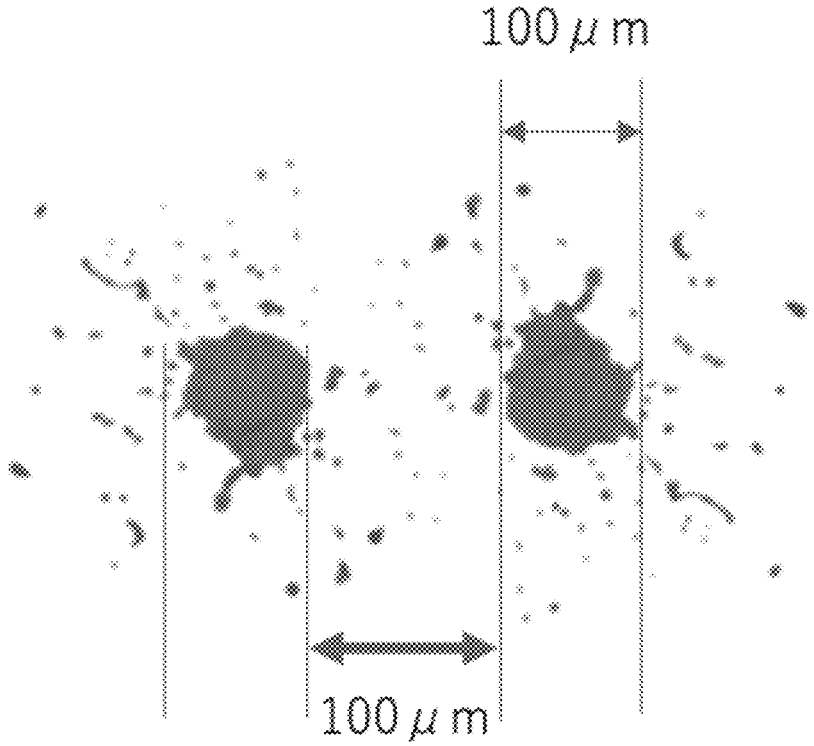
FIG. 15B is a view illustrating an example of a microscopic image of a sample transferred using a Gaussian laser beam.

It was found that, the case of using the optical vortex laser beam as illustrated in FIG. 15A was more excellent than the case of using the Gaussian laser beam as illustrated in FIG. 15B in terms of the ability to transfer the matrix to the targeted area with a less degree of scattering. Use of the optical vortex laser beam makes it possible to narrow the gap between the matrices to be transferred and transfer various kinds of matrices at high density.

Reference Example

MALDI mass spectrometry was performed in the same manner as in Example 1, except that measurement samples for MALDI mass spectrometry were produced using Matrix Plate A and Matrix Plate B in separate sample sections not in the same one sample section. A spectrum obtained by using Matrix A (sinapic acid) is presented in FIG. 8A, and a spectrum obtained by using Matrix B (dithranol) is presented in FIG. 8B.

Figure 8A:
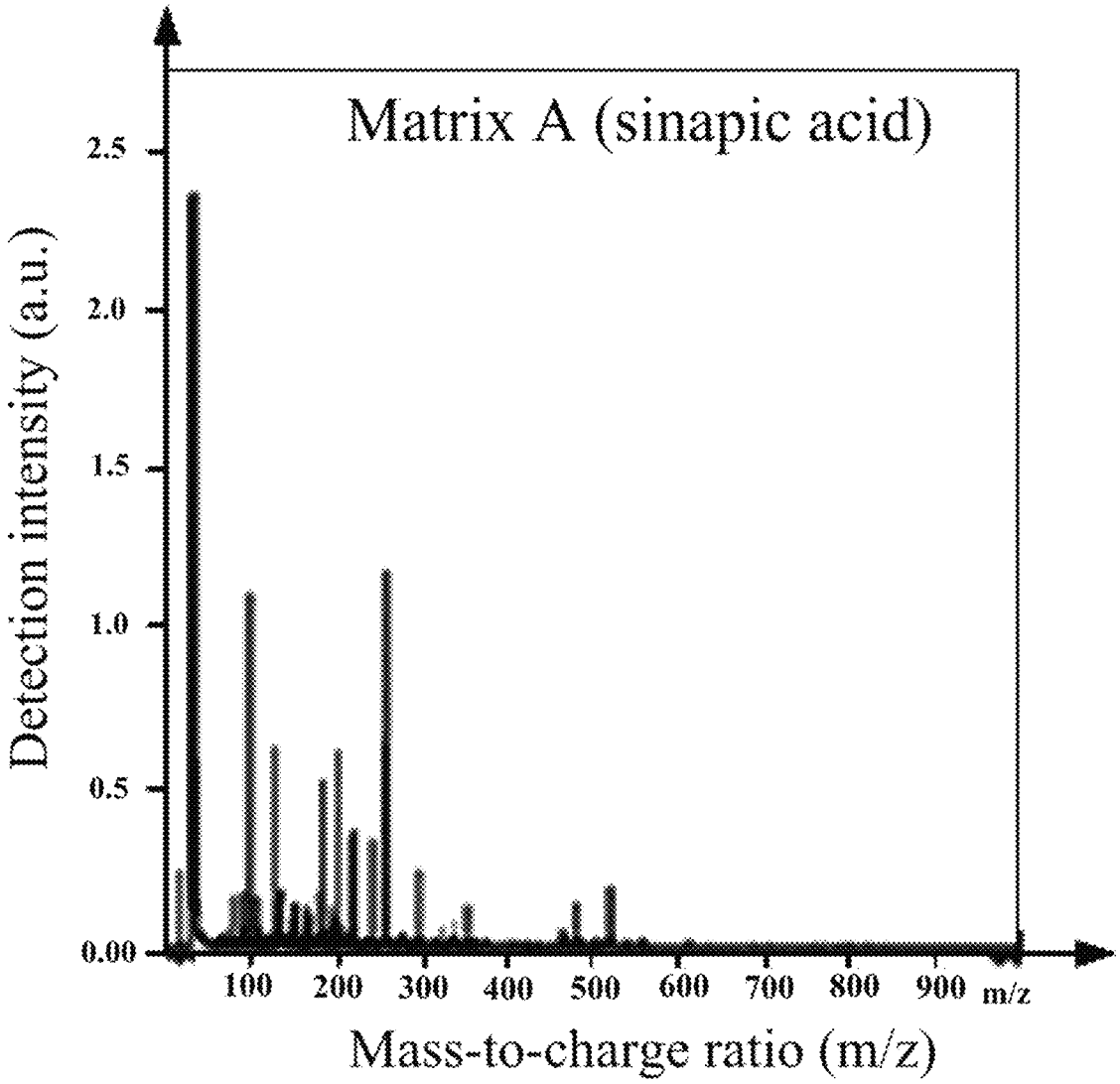
FIG. 8A is a graph depicting a spectrum obtained using Matrix A, as a result of MALDI mass spectrometry in Reference Example.
Figure 8B:
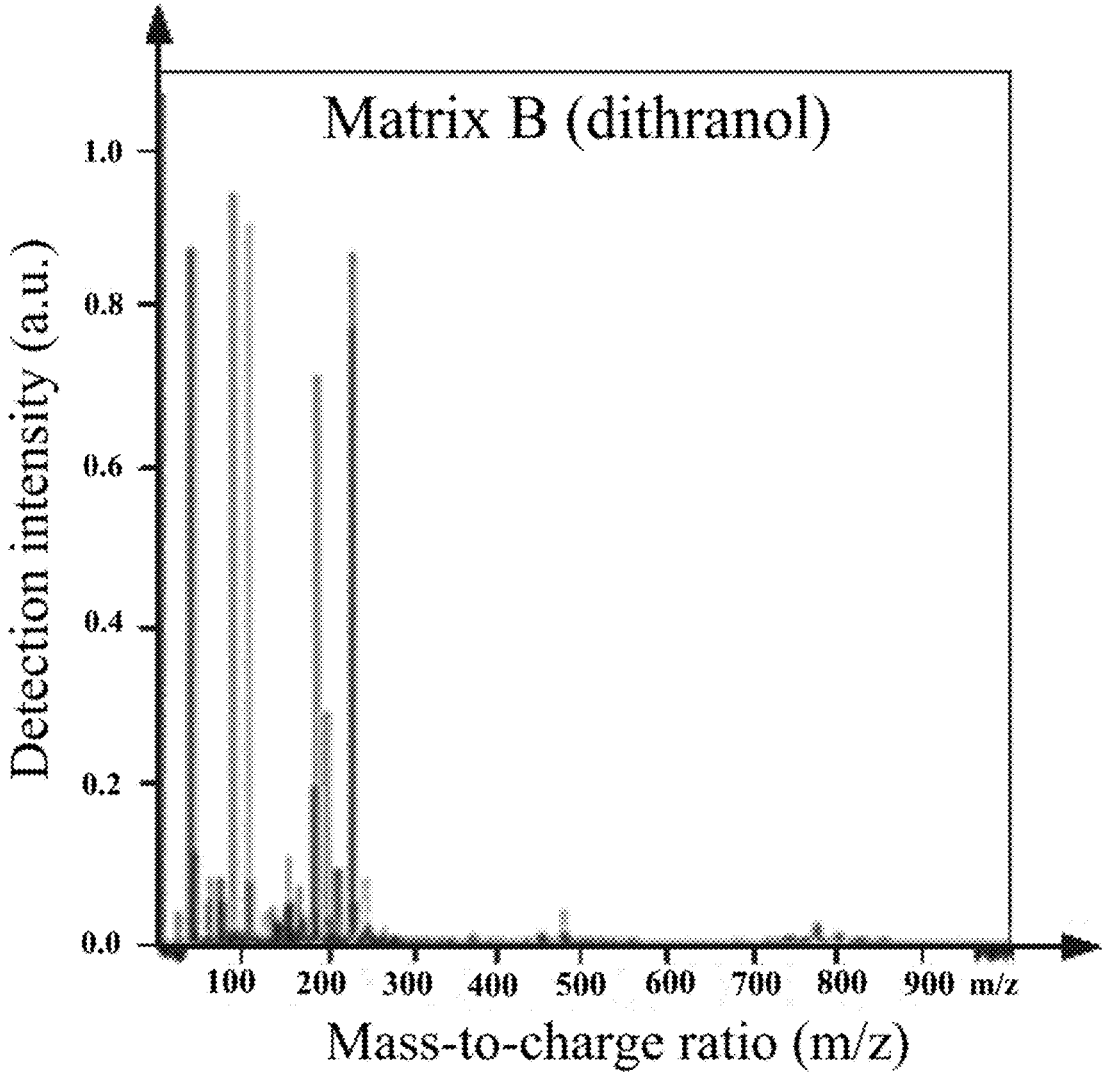
FIG. 8B is a graph depicting a spectrum obtained using Matrix B, as a result of MALDI mass spectrometry in Reference Example.

As illustrated in FIGS. 8A and 8B, the results similar to FIGS. 7A and 7B of Examples could be obtained. This indicates that the MALDI mass spectrometry method of the present disclosure could dispose two or more kinds of matrices on one sample section. In other words, even when there is only one sample and use of two or more kinds of matrices is intended for MALDI mass spectrometry, a MALDI mass spectrometry result corresponding to each matrix can be obtained.

As described above, two or more kinds of matrices could be disposed on one sample according to the method of the present disclosure for preparing a measurement sample for MALDI mass spectrometry. Therefore, analytes, such as a protein, a lipid, and a nucleotide, can be measured with high sensitivity even when there is only one sample. Accordingly, even when there is a plurality of analytes in one sample, the method of the present disclosure for preparing a measurement sample for MALDI mass spectrometry enables highly sensitive imaging mass spectrometry for each analyte. The method of the present disclosure for preparing a measurement sample for MALDI mass spectrometry can be suitably applied for, for example, analysis of drug delivery.

As described above, the method of the present disclosure for preparing a measurement sample for MALDI mass spectrometry includes applying a laser beam to a base containing a matrix disposed on a surface of the base, in a manner that the laser beam is applied to a surface of the base opposite to the surface on which the matrix is disposed, to make the matrix fly from the base to be disposed at a predetermined position of an analyte of MALDI mass spectrometry. The method of the present disclosure for preparing a measurement sample for MALDI mass spectrometry is able to dispose two or more kinds of matrices on one sample in mass spectrometry using MALDI.

Embodiments of the present disclosure are, for example, as follows.

<1> A method for preparing a measurement sample for MALDI mass spectrometry, the method including:

applying a laser beam to a base containing a matrix disposed on a surface of the base, in a manner that the laser beam is applied to a surface of the base opposite to the surface on which the matrix is disposed, to make the matrix fly from the base to be disposed at a predetermined position of an analyte of MALDI mass spectrometry.

<2> The method according to <1>, wherein the matrix made fly from the base is two or more kinds of matrices.

<3> The method according to <2>, wherein the two or more kinds of matrices made fly from the base are disposed at mutually different predetermined positions of the analyte of MALDI mass spectrometry.

<4> The method according to any one of <1> to <3>, wherein the matrix is made fly twice or more from the base to be disposed at the predetermined position of the analyte of MALDI mass spectrometry.

<5> The method according to any one of <1> to <4>, wherein the laser beam is an optical vortex laser beam.

<6> The method according to any one of <1> to <5>, wherein an irradiation diameter of the laser beam is 5 μm or greater but 100 μm or less.

<7> The method according to any one of <1> to <6>, wherein the matrix disposed on the surface of the base is in a state of a layer or dots or in a state of both a layer and dots.

<8> A device for preparing a measurement sample for MALDI mass spectrometry including:

an irradiation unit configured to apply a laser beam to a surface of a base based on any one of the method according to any one of claims 1 to 7.

<9> A measurement sample for MALDI mass spectrometry, the measurement sample including:

an analyte of MALDI mass spectrometry; and two or more kinds of matrices disposed at predetermined positions of the analyte.

<10> A MALDI mass spectrometry method including:

performing MALDI mass spectrometry with the measurement sample for MALDI mass spectrometry according to <9>.

<11> A non-transitory recording medium for preparing a measurement sample for MALDI mass spectrometry, the non-transitory recording medium storing a plurality of instructions which, when executed by one or more processors, cause the processors to perform a method including:

based on position information of an analyte of MALDI mass spectrometry, applying a laser beam to a base containing a matrix disposed on a surface of the base, in a manner that the laser beam is applied to a surface of the base opposite to the surface on which the matrix is disposed, to make the matrix fly from the base to be disposed at a predetermined position of the analyte of MALDI mass spectrometry.

The method for preparing a measurement sample for MALDI mass spectrometry according to any one of <1> to <7>, the device for preparing a measurement sample for MALDI mass spectrometry according to <8>, the measurement sample for MALDI mass spectrometry according to <9>, the MALDI mass spectrometry method according to <10>, and the non-transitory recording medium for preparing a measurement sample for MALDI mass spectrometry according to <11> solve the above-described various problems existing in the art and can achieve the object of the present disclosure.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A method for preparing a measurement sample for MALDI mass spectrometry, the method comprising:

applying a laser beam to a first base containing a matrix disposed on a first surface of the first base, in a manner that the laser beam is applied to a second surface of the first base opposite to the first surface on which the matrix is disposed, to make the matrix fly from the first base to be transferred to a predetermined position of an analyte of MALDI mass spectrometry, the analyte being separately disposed on a surface of a second base facing the first surface of the first base.

2. The method according to claim 1, wherein the matrix made to fly from the base includes two or more kinds of matrices.

3. The method according to claim 2, wherein the two or more kinds of matrices made to fly from the base are transferred to mutually different predetermined positions of the analyte of MALDI mass spectrometry.

4. The method according to claim 1, wherein the matrix is made to fly twice or more times from the base to be transferred to the predetermined position of the analyte of MALDI mass spectrometry.

5. The method according to claim 1, wherein the laser beam is an optical vortex laser beam.

6. The method according to claim 1, wherein an irradiation diameter of the laser beam is 5 μm or greater but 100 μm or less.

7. The method according to claim 1, wherein the matrix disposed on the surface of the base is in a state of a layer or dots or in a state of both a layer and dots.

8. A device for preparing a measurement sample for MALDI mass spectrometry, comprising:

an irradiation unit configured to apply the laser beam to the second surface of the first base based on the method according to claim 1.

9. The method of claim 1, further comprising:

receiving irradiation data including position information of the analyte, and moving an irradiation position of the laser beam based on the received position information.

10. A measurement sample for MALDI mass spectrometry, the measurement sample comprising:

an analyte of MALDI mass spectrometry; and two or more kinds of matrices disposed at predetermined positions of the analyte.

11. A MALDI mass spectrometry method comprising:

performing MALDI mass spectrometry with the measurement sample for MALDI mass spectrometry according to claim 10.

12. A non-transitory recording medium for preparing a measurement sample for MALDI mass spectrometry, the non-transitory recording medium storing a plurality of instructions which, when executed by processing circuitry, cause the processing circuitry to perform a method, comprising:

based on position information of an analyte of MALDI mass spectrometry, applying a laser beam to a first base containing a matrix disposed on a first surface of the first base, in a manner that the laser beam is applied to a second surface of the first base opposite to the first surface on which the matrix is disposed, to make the matrix fly from the first base to be transferred to a predetermined position of the analyte of MALDI mass spectrometry, the analyte being separately disposed on a surface of a second base facing the first surface of the first base.

* * * * *